US009981784B2

(12) United States Patent
Craig

(10) Patent No.: US 9,981,784 B2
(45) Date of Patent: May 29, 2018

(54) MANWAY COVER

(71) Applicant: BAIER MARINE COMPANY, INC., Costa Mesa, CA (US)

(72) Inventor: Ronald Scott Craig, Elverta, CA (US)

(73) Assignee: BAIER MARINE COMPANY, INC., Costa Mesa, CA (US)

( * ) Notice: Subject to any disclaimer, the term of this patent is extended or adjusted under 35 U.S.C. 154(b) by 0 days. days.

(21) Appl. No.: 15/393,672

(22) Filed: Dec. 29, 2016

(65) Prior Publication Data

US 2017/0240322 A1 Aug. 24, 2017

Related U.S. Application Data

(63) Continuation of application No. PCT/US2015/039097, filed on Jul. 2, 2015.

(60) Provisional application No. 62/020,977, filed on Jul. 3, 2014.

(51) Int. Cl.

| | |
|---|---|
| ***B61D 5/00*** | (2006.01) |
| ***B65D 45/30*** | (2006.01) |
| ***B65D 90/10*** | (2006.01) |
| ***B65D 43/16*** | (2006.01) |
| ***B65D 43/22*** | (2006.01) |
| ***B65D 47/00*** | (2006.01) |
| ***B65D 90/00*** | (2006.01) |

(52) U.S. Cl.

CPC ..... *B65D 45/305* (2013.01); *B61D 5/08* (2013.01); *B65D 43/167* (2013.01); *B65D 43/22* (2013.01); *B65D 47/00* (2013.01); *B65D 90/10* (2013.01)

(58) Field of Classification Search

CPC ..... B61D 17/00; B61D 17/12; B61D 17/14; B61D 17/16; B61D 39/00; B61D 39/001; B61D 39/008

USPC ..... 105/355, 359, 377.01, 377.07, 377.08, 105/377.11

See application file for complete search history.

(56) References Cited

U.S. PATENT DOCUMENTS

| | | | | |
|---|---|---|---|---|
| 3,977,124 | A * | 8/1976 | Oger | E02D 29/1427 49/463 |
| 4,279,356 | A * | 7/1981 | Amorese | F16J 13/20 220/314 |
| 4,461,597 | A * | 7/1984 | Laurin | E02D 29/1427 137/371 |
| 5,324,135 | A * | 6/1994 | Smith | E02D 29/1427 210/164 |
| 2017/0240322 | A1* | 8/2017 | Craig | B65D 45/305 |

* cited by examiner

*Primary Examiner* — Jason C Smith

(74) *Attorney, Agent, or Firm* — Knobbe, Martens, Olson & Bear, LLP

(57) ABSTRACT

A manway cover assembly can be used to control access to the interior of a railroad tank car or other type of tank or structure. The manway cover assembly can have a tightening system, such as a screw tightening system and an attachment system. The attachment system can have a ledge configured to engage a flange that surrounds an opening. A cover can control access to the opening. The tightening system can secure the ledge to the flange and lock the cover over the opening. A manway cover assembly can also be used for selectively sealing an access passageway of a tank. The manway cover assembly can have an internal seal that remains sealed independent of movement between the cover and the opening within a set range of movement.

17 Claims, 26 Drawing Sheets

MANWAY COVER

INCORPORATION BY REFERENCE TO ANY PRIORITY APPLICATIONS

Any and all applications for which a foreign or domestic priority claim is identified in the Application Data Sheet as filed with the present application are incorporated by reference under 37 CFR 1.57 and made a part of this specification.

BACKGROUND OF THE INVENTION

Field of the Invention

Certain embodiments disclosed herein relate generally to manway cover assemblies for railroad tank cars. The manway cover assemblies can also be used to control access to the interior of other types of tanks and structures.

Description of the Related Art

The current industry standard design for manway cover assemblies on railroad tank cars involves bolting down a cover with a series of eye bolts, many of the systems have a large number of bolts, such as 6 or 8 bolts. The design is very old and can result in costly failures for operators. Failures of the manway cover assemblies can result in daily fines accruing for the railroad operator.

The bolt-down design was originally intended to be secured by a hand wrench and tightened carefully in a star pattern. Crews charged with attaching the covers are under time pressures, thus, they commonly use impact wrenches while also ignoring the star pattern sequence. Common problems result from setting torque limits improperly and over tighten the nuts. This leads to stripped, stretched or broken eye-bolts, as well as deformed covers. Ultimately, the result is failure of the seal and leakage at the cover because of user error.

SUMMARY OF THE INVENTION

Accordingly, there is a need in the art for improved manway cover assemblies for use with railroad tank cars, among other things. A manway cover assembly according to certain embodiments can overcome one or more issues with the prior art. For example, the manway cover assembly can quickly and effectively be sealed while removing or reducing the opportunity for user error.

In some embodiments, a manway cover assembly can comprise a cover, a strongback, and a ram. The strongback can comprise a threaded opening and a plurality of arms, each arm comprising a ledge. The ram can have a threaded body, the ram connected to the cover and the threaded body being positioned within the threaded opening of the strongback. The ram can be configured to change the relationship between the strongback and the cover as the ram rotates. The manway cover assembly can be configured to control access to an opening, each ledge of each arm configured to move to engage a structure surrounding the opening to move the manway cover assembly to a locked position, as rotation of the ram forces the strongback away from the cover until each ledge engages the structure.

According to some embodiments, a manway cover assembly can comprise a frame, a cover, a strongback, and a ram. The frame can define an opening and comprise a flange. The cover can be hingedly attached to the frame and thereby configured to move between a first position spaced away from the opening and a second position covering the opening. The strongback can comprise a threaded opening and a plurality of arms, each arm comprising a ledge. The ram can have a threaded body and an end having a spherical surface. The spherical surface can be rotatingly connected to the cover and the threaded body can be positioned within the threaded opening of the strongback and configured to change the relationship between the strongback and the cover as the ram rotates. The manway cover assembly can be configured such that when the cover is in the second position covering the opening, each ledge of each arm is configured to move to engage the flange to move the manway cover assembly to a locked position, as rotation of the ram forces the strongback away from the cover until each ledge engages the flange.

According to some embodiments, a manway cover assembly can comprise a screw tensioning system, a frame defining an opening, and a cover. The screw tensioning system can comprise a tensioning arm with a slot and a ram having a threaded body. The tensioning arm can be engaged with the ram through the threaded body. The slot of the tensioning arm can be configured to slide onto the frame when the cover is positioned over the opening. The ram can be attached to the cover with a rotatable joint and configured such that rotation of the ram changes the relationship between the cover and the tensioning arm to lock or unlock the manway cover assembly. Locking can occur when turning the ram forces the cover into contact with the frame while advancing the tensioning arm away from the cover, the tensioning arm being fixed in place with relation to the frame because of the slot that engages the frame.

In some embodiments, a manway cover assembly can be used for selectively sealing an access passageway of a tank. The manway cover assembly can comprise a frame, a lid unit and a securing mechanism to secure the lid unit with the frame when the lid unit is in a closed position. The frame can comprise a radially inner surface, a radially outer surface, and an axial axis. A first end portion of the frame can be adapted to be joined with the tank. A second end portion is axially opposite the first end portion. The second end portion can have a radially inner edge and define an opening. The lid unit can be rotatably connected with the frame and moveable between an open position and a closed position. The lid unit can cover the opening of the second end portion of the frame in the closed position.

The lid unit can comprise a cover with a flange having a radially-outwardly opening groove and a sealing ring in the radially-outwardly opening groove. The flange can be received in the opening of the frame when the lid unit is in the closed position. The lid unit can be configured such that, when the lid unit is in the closed position, the sealing ring is radially compressed between a back surface of the groove and the radially inner edge of the second end portion of the frame, thereby providing a sealing connection between the lid unit and the frame. The securing mechanism can comprises a single bolt or multi-bolt system.

According to some embodiments, a manway cover assembly can comprise a conduit comprising a radially inner wall, an opening, and a radially outer wall with a plurality of connection points; a cover configured to couple with the conduit, the cover movable between open and closed positions; and a securing mechanism. The cover can comprise a plurality of recesses corresponding to the plurality of connection points; a flange configured to be received in the opening of the conduit when the cover is in the closed position, the flange comprising a groove with a back surface, the groove opening in a radially-outward direction; and a seal in the groove, the seal being radially compressed between the radially inner wall of the conduit and the back surface of the groove when the cover is in the closed position. The securing mechanism can include a plurality of eye bolts corresponding to the plurality of connection points, one of each of the eye-bolts connected with the conduit via one of the connection points, the eye-bolts configured to engage with the recesses in the cover and to secure the cover relative to the conduit.

A method of manufacturing a manway cover assembly can include one or more of the following steps. Obtaining a frame comprising a radially inner wall and a passageway. Obtaining a lid unit comprising a cover and a flange, the flange comprising a radially outwardly opening groove. Installing a sealing ring in the radially outwardly opening groove. Connecting the lid unit with the frame. Rotating the lid unit relative to the frame such that the lid unit covers the passageway in the frame. Radially compressing the sealing ring between the radially inner wall of the frame and the groove. Securing the lid unit relative to the frame.

A method of using a manway cover assembly can inhibit leakage from a passageway of a tank. The manway cover assembly can comprise a lid unit and a frame, the lid unit comprising a cover and a flange, the flange comprising a radially outwardly opening groove, the frame comprising a radially inner wall and an opening. The method can comprise closing the manway cover assembly, wherein closing the manway assembly can comprise: moving the lid unit into engagement with the frame such that the flange is received inside the opening of the frame; covering the passageway of the tank with the lid unit; radially compressing the sealing ring between the radially inner wall of the frame and the radially outwardly opening groove; and forming an air-tight seal between the sealing ring and the frame. The method can further include securing the manway cover assembly, wherein securing the manway cover assembly can comprise: engaging a securing mechanism with at least one of the lid unit and the frame; and substantially immobilizing, with the securing mechanism, the lid unit relative to the frame when the tank is at about atmospheric pressure. Pressurizing the tank above atmospheric pressure can cause the lid unit to move upward, away from the frame. This can cause sliding of the sealing ring along the inner wall of the frame. The method can further include maintaining the air-tight seal between the sealing ring and the frame.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION

A manway cover is commonly used as an access door or hatch to the interior of a tank, such as a railroad tank car. They can also be used to access other types of tanks and other types of structures. In broad terms, the manway cover assembly can have a tightening system, such as a screw tightening system and an attachment system. The attachment system can have a ledge configured to engage a flange that surrounds an opening. A cover can control access to the opening. The tightening system can secure the ledge to the flange and lock the cover over the opening. The embodiments are described herein with reference to tank cars, but it will be understood that the described manway, components and methods are not limited to this use. In addition, though the manway may be sized sufficient for a person to pass therethrough, this is not required.

Also discussed herein are certain sealing systems that can be used on different types of manway covers. The sealing systems can be used together with single bolt, or multi-bolt type tightening systems. It will be understood that additional features discussed herein can be used with or without the described sealing systems and/or tightening systems.

Figure 1:
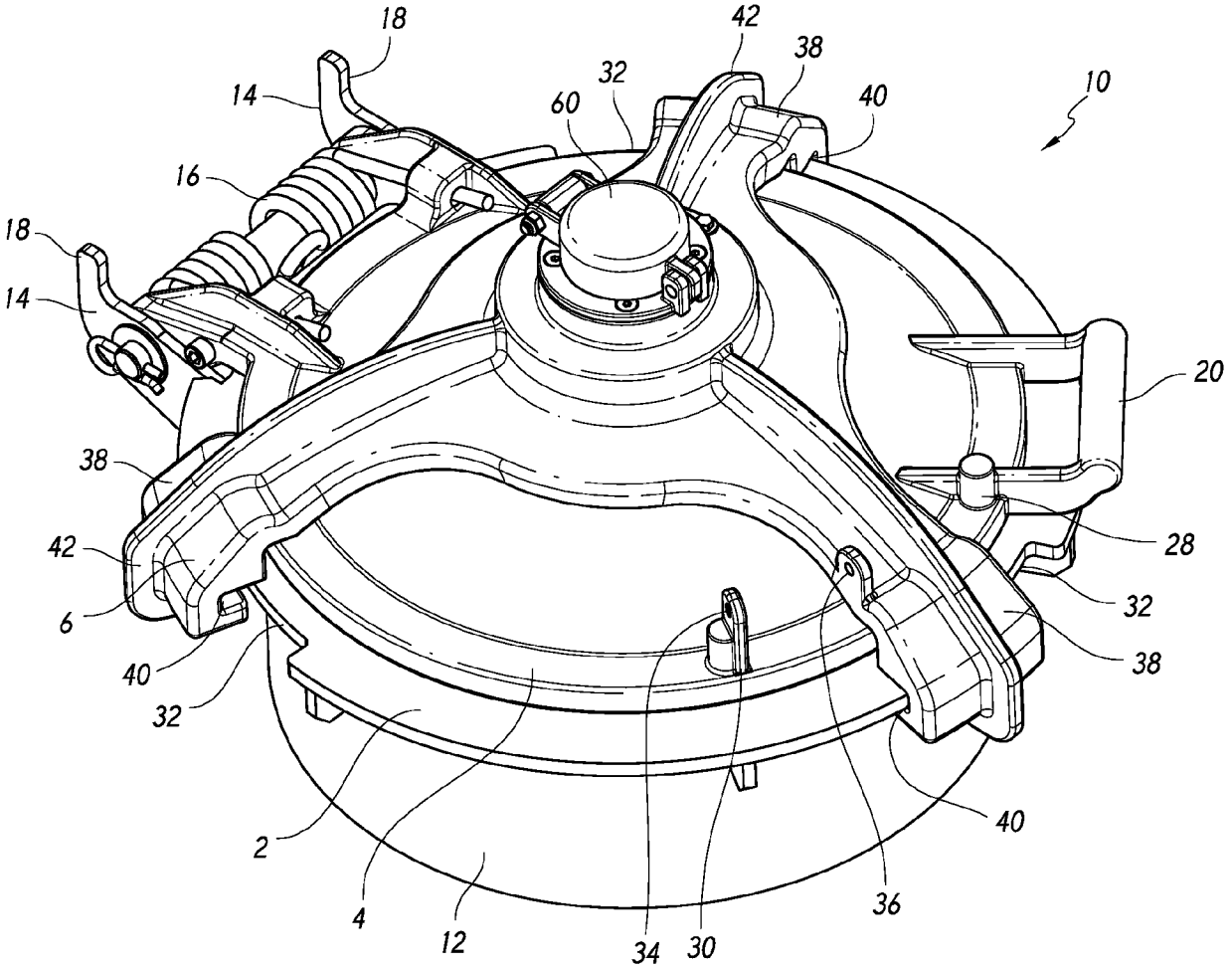
FIG. 1 is a perspective view of a manway cover assembly for a railroad car with the cover in a closed position.
Figure 2:
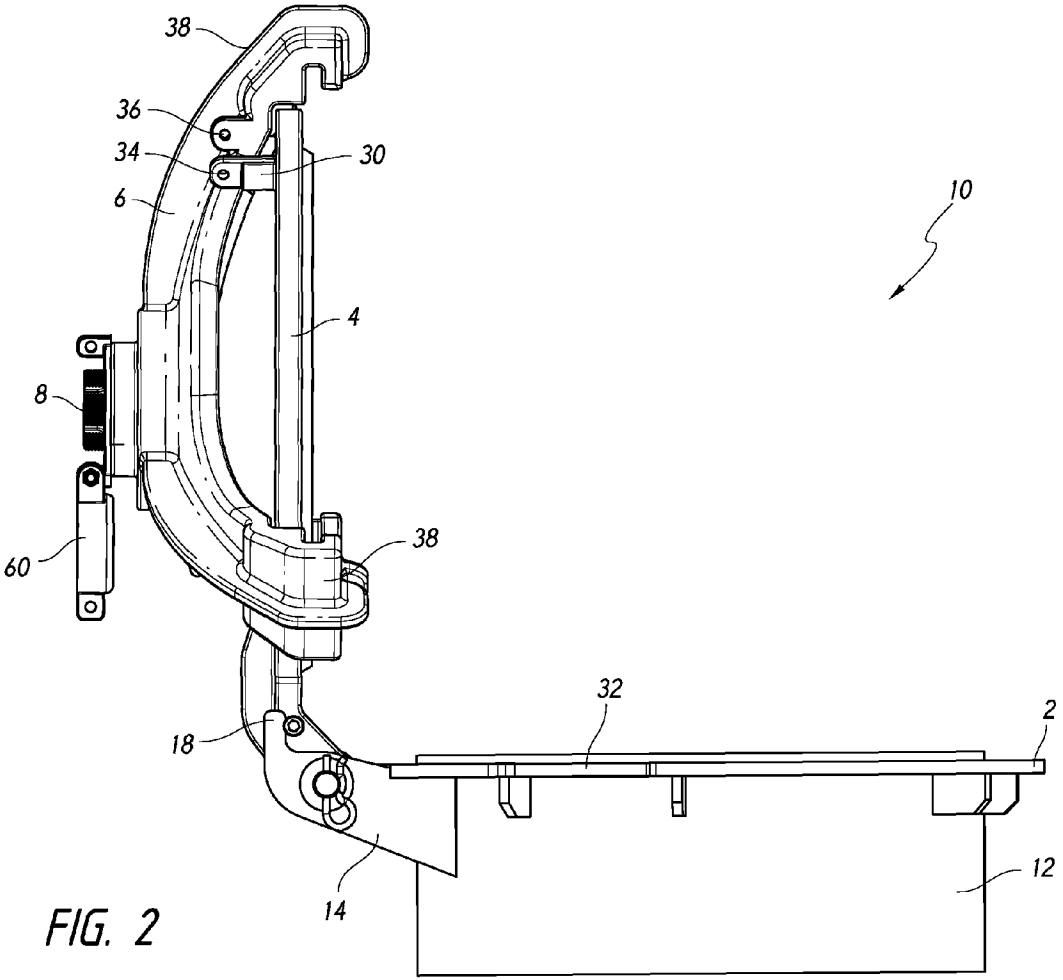
FIG. 2 is a side view of the manway cover assembly in an open position.

FIGS. 1 and 2 illustrate a manway cover assembly 10 for a railroad car with the cover in respective closed and open positions. A manway cover assembly 10 can provide quick access to the interior of a tank. A manway cover assembly 10 can include a tightening system and an attachment or closure system. The tightening system can be a screw tightening system with a ram 8, though other types of tightening systems can also be used. The ram 8 can be a single bolt type tightening system.

Figure 3:
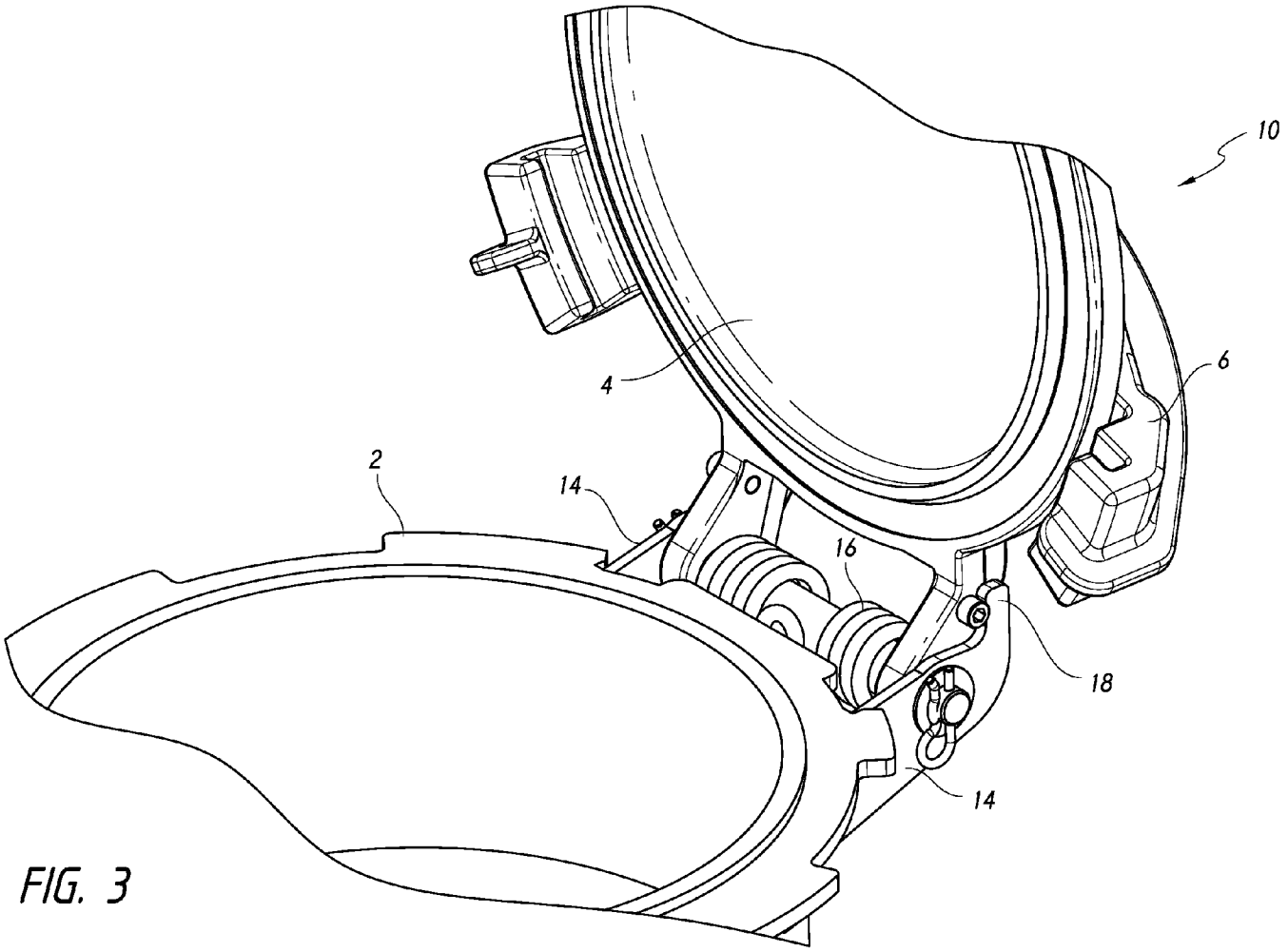
FIG. 3 shows a detail view of a hinged cover of the manway cover assembly in an open position.

As best seen in FIGS. 2 and 3, the manway cover assembly 10 can include a flange 2, a cover 4, a strongback 6, a ram 8, and a nozzle 12. Engagement between the cover 4 and either the flange 2 or the nozzle can control access to the tank or other structure through the manway cover assembly 10. The strongback 6 and ram 8 can be used with the flange 2, cover 4 and nozzle 12 to secure the manway cover assembly 10 in a locked position, as well as providing certain additional benefits as described below. For example, the ram 8 can be used to change the relationship between the strongback 6, the flange 2 and the cover 4 to increase or decrease pressure and/or the distances between these various components as will be described in more detail below.

According to the various embodiments, the manway cover assembly 10 can include one or more additional features as described herein. It is to be understood that the illustrated manway cover assembly 10 includes each of the features designated by the numbers used herein. However, these features need not be present in all embodiments.

A tank, such as a railroad tank car, can have an opening to which a manway cover assembly 10 can be attached to control access through the opening. A frame can be fixedly positioned with respect to the opening and the cover 4 can open and close the opening by engaging the frame. The frame can include a flange 2 and a nozzle 12. The flange 2 can be fixedly positioned with respect to the opening and the cover 4 can open and close the opening by engaging the frame (flange 2 and/or nozzle 12) or some other portion at or surrounding the opening. Typically, a manway cover assembly 10 has a nozzle 12 attached to the tank at the opening. The illustrated nozzle 12 is a short cylinder which can easily attach to an opening in a wall of a tank. The nozzle 12 can be welded or otherwise secured to the tank and the flange can be attached to the nozzle 12. The flange 2 may be welded to the nozzle and may be a flange weldment 2 as shown. Other attachment methods can also be used. The illustrated nozzle 12 is cylindrical, though other shapes can also be used.

As will be understood, the nozzle 12 can also define an opening. The nozzle opening can be any number of different sizes. In some embodiments the opening can have a diameter of about 18 inches (in), 20 in, 22 in, or between 15 in and 30 in.

In some embodiments, the flange 2 can have one or more slots 32. The slots 32 can be used to facilitate engagement with the strongback 6 as will be described in more detail below.

In some embodiments, the cover is a hinged cover 4. The cover 4 can be connected directly to the hinge to keep the cover properly aligned with the opening in the tank car. The hinged cover 4 can be pivotally connected to a bracket 14 (FIGS. 2-3). The bracket 14 can be attached to one or more of the flange 2, the nozzle 12 or some other structure. In some embodiments, the bracket 14 can be directly attached to the tank. As will be understood by those of skill in the art, various features such as a spring 16, stops 18, and a handle 20 (FIG. 1) can be used to control and/or assist with the opening and closing of the hinged cover 4.

Figure 4:
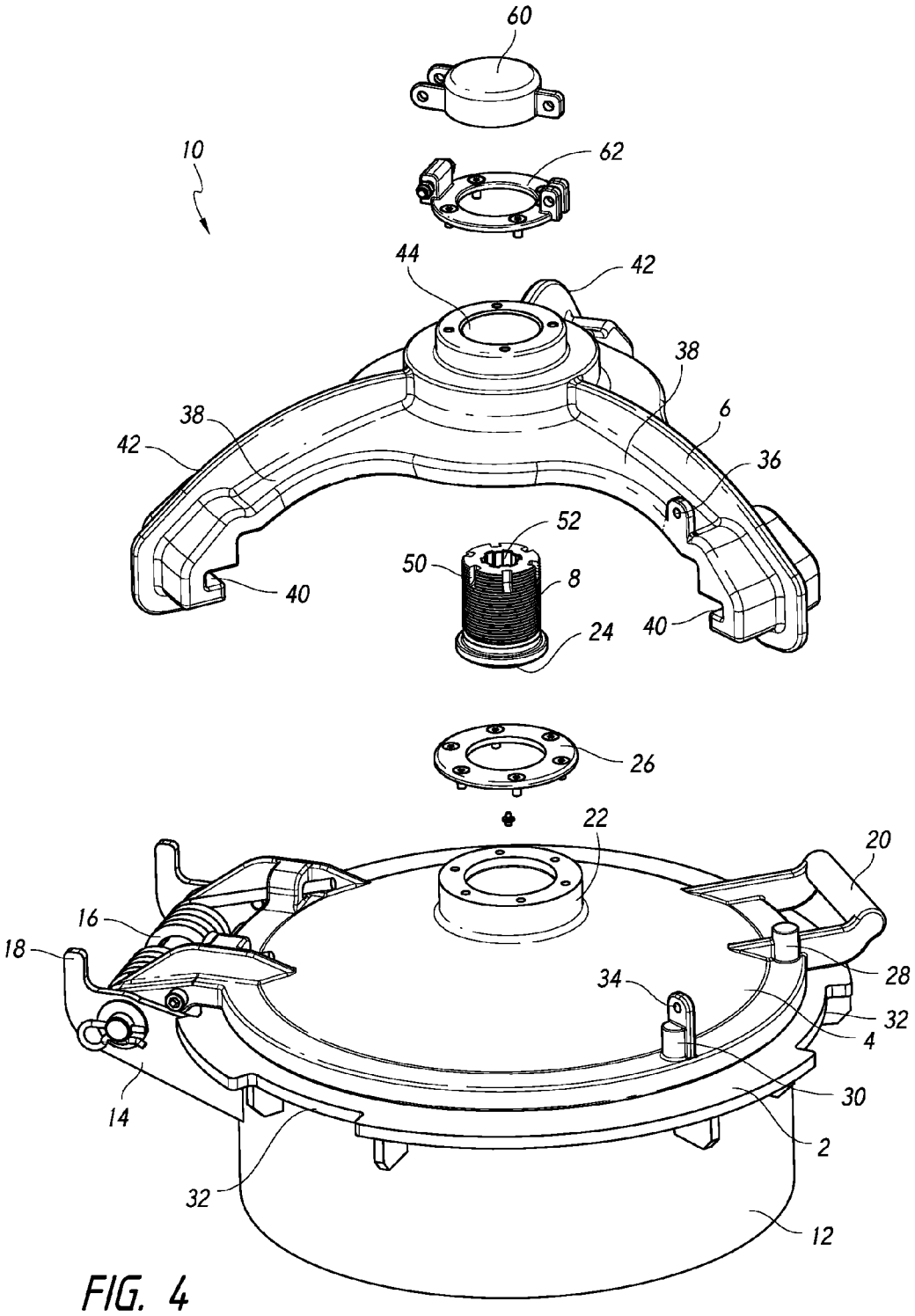
FIG. 4 is a partially exploded view of the manway cover assembly.
Figure 5:
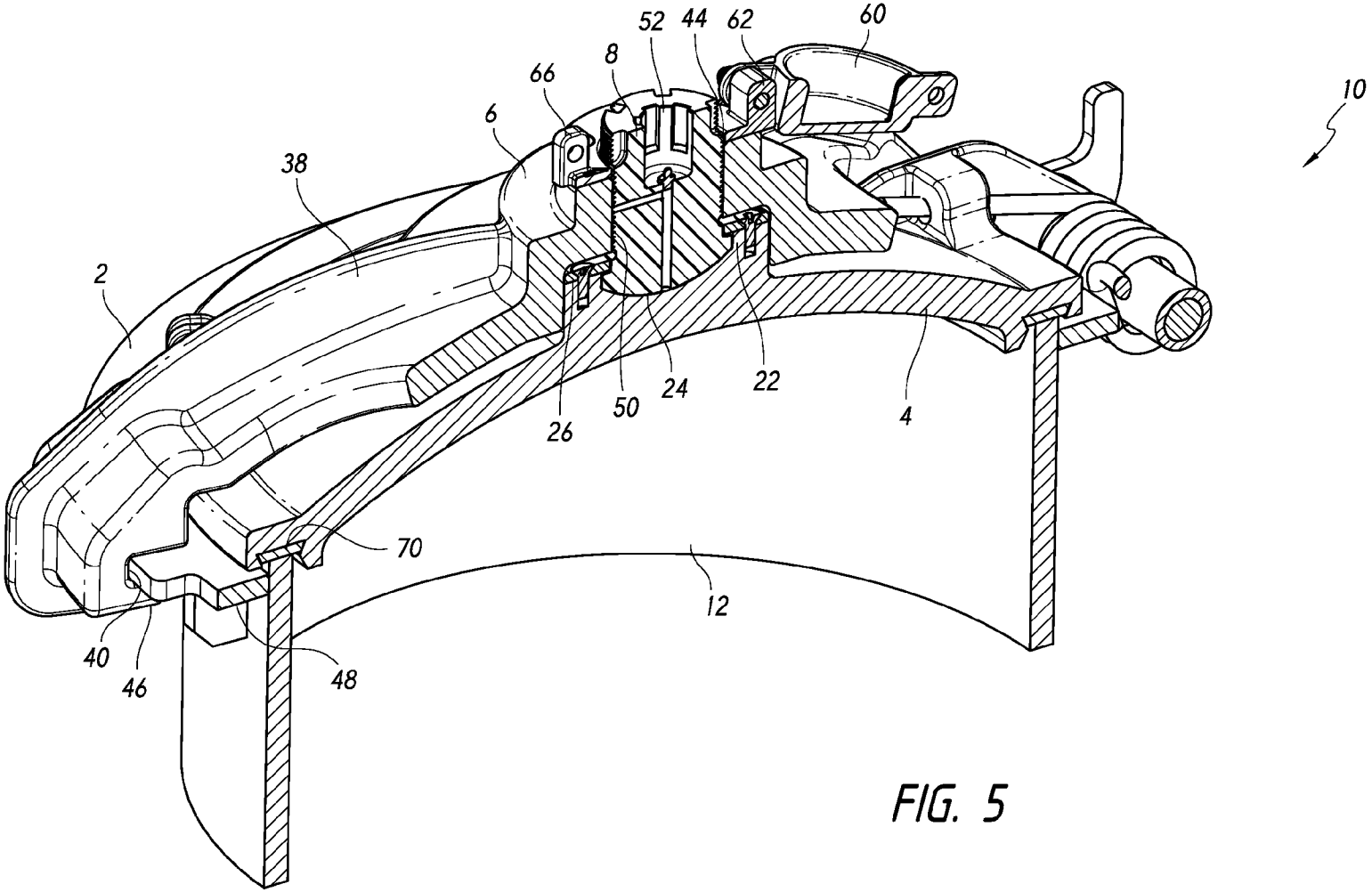
FIG. 5 illustrates a cross-section of the manway cover assembly in a closed position.

A strongback 6 can be attached to the cover 4 through a ram 8 (FIGS. 4-5). The strongback 6 can be a type of secondary support member to the cover 4. In particular, the strongback 6 can be used to help secure and lock the cover in place, while also providing for quick and easy release of the cover. The strongback 6 can connect to both the cover 4 and the flange 2. With the cover in place on the nozzle 12 and the strongback engaged with both the cover and the flange, the ram 8 can then be used to force the strongback 6 and the cover 4 away from each other as shown in FIG. 5. Further, a sealing member 70, such as a gasket can be positioned between the nozzle 12 and the cover 4. The sealing member 70 can be a sealing ring with any number of different profiles. The strongback 6 and ram 8 can help ensure that the cover 4 and nozzle 12 remain sealed even under high pressure.

In the illustrated embodiment, the cover 4 has a boss 22 in the center providing a centering pivot for the strongback 6. The ram 8 can have one end positioned inside the boss 22, while the other end is threadedly connected to the strongback 6. Rotation of the ram 8 can result in the strongback 6 moving either towards or away from the cover as illustrated by the double-headed arrows. The ram 8 can be configured to rotate in place with respect to the cover. Inside the boss 22 a spherical contact surface 24 can match a spherical contour of the threaded ram 8 to form a rotatable joint. This can facilitate rotation of the ram while reducing friction.

It will be understood that the illustrated arrangement of the strongback, ram and cover can be varied in many ways. For example, in some embodiments, the ram can be positioned off-center, the ram can be received within the cover without a boss, and/or the cover can be threadedly connected to the ram instead of the strongback. In addition, the matching spherical surfaces 24 of the ram and boss can have other shapes. For example, the ram end can be a radially extending protrusion or disk shape. As another example, the ram can have a ball end and the boss and/or cover can have a corresponding socket. With a spherical and/or ball surface, the ram may be provided with some angular movement, such as to tilt one side of the strongback 6 slightly downwards or upwards.

With continued reference to FIGS. 4-5, the ram can be secured within the cover 4 and/or boss 22 with a separate plate 26. The plate 26 can be a bolted flange on the top surface (illustrated), a snap ring or other system to maintain the end of the ram within the boss and/or cover.

In addition to providing a pivot surface (and potentially centering for the strongback 6), the cover 4 can also provide rotation limiting stops 28, 30 (FIGS. 1 & 4). The rotation limiting stops can control the open and closed positions of the strongback during operation of the manway cover assembly 10 as will be described in more detail below. Additionally, the closed stop 30 is illustrated with a flange, or tab, with a hole 34 that can align with a similar tab with a hole 36 on the strongback 6. When the strongback 6 is in the closed position, the holes 34, 36 in these tabs can accept a security sealing tag or other security or locking device to prevent the manway cover assembly 10 from being opened. In some embodiments, the open stop 28 can have a similar tab and hole to receive a security or locking device.

The strongback 6 can include one or more arms 38 as best seen in FIGS. 1 and 4. In the illustrated embodiment, the strongback includes three arms 38, though one, two, four or more arms could be used. The arms 38 can extend the required distance to another surface for securing the arms with respect to this surface. For example, the arms 38 can extend beyond the outside diameter of the cover 4 for engagement with the nozzle 12 and/or flange weldment 2. The arms can include one or more engagement features 40, such as the slots 40. The slots 40 are shown at the end of the arms, though it will be understood that they can also be positioned elsewhere on the arm. The slots 40 on the arms can be sized to engage the flange 2. Thus, the slots 40 can be as wide as the flange is thick. In some embodiments the slots can be wider than the thickness of the flange. This can facilitate attachment of the arms to the flange, as well as provide a pressure relief safety feature.

Figure 10:
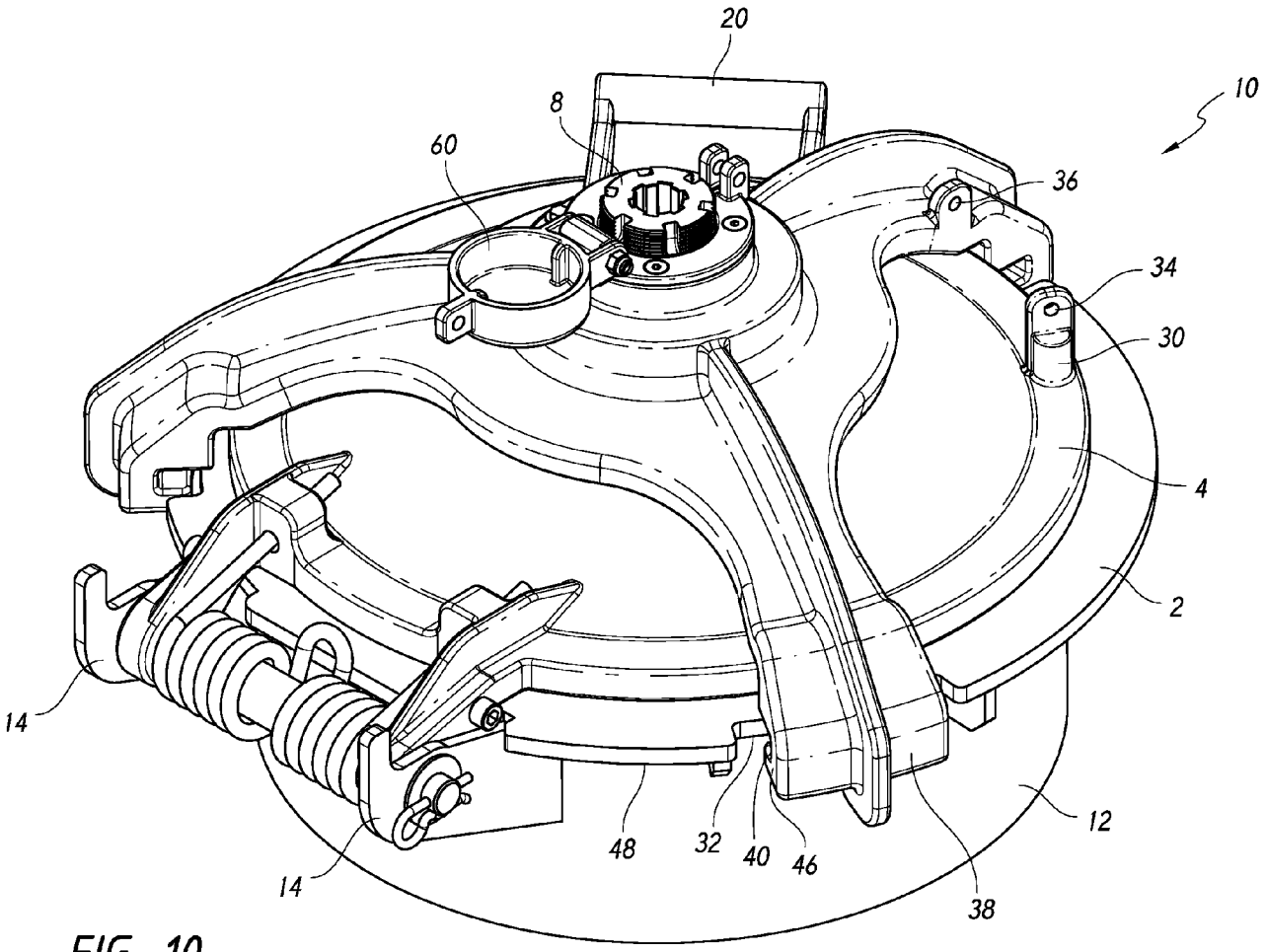
Figure 11:
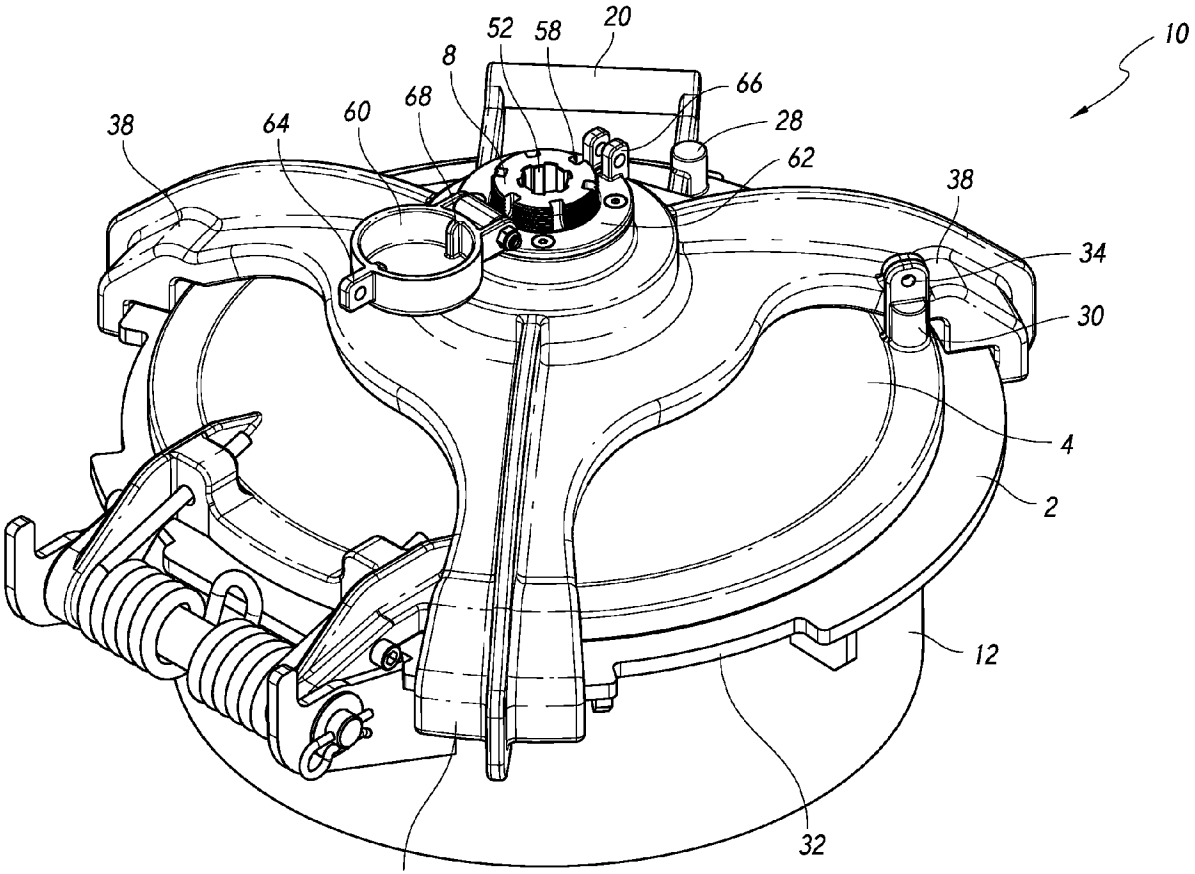
Figure 12:
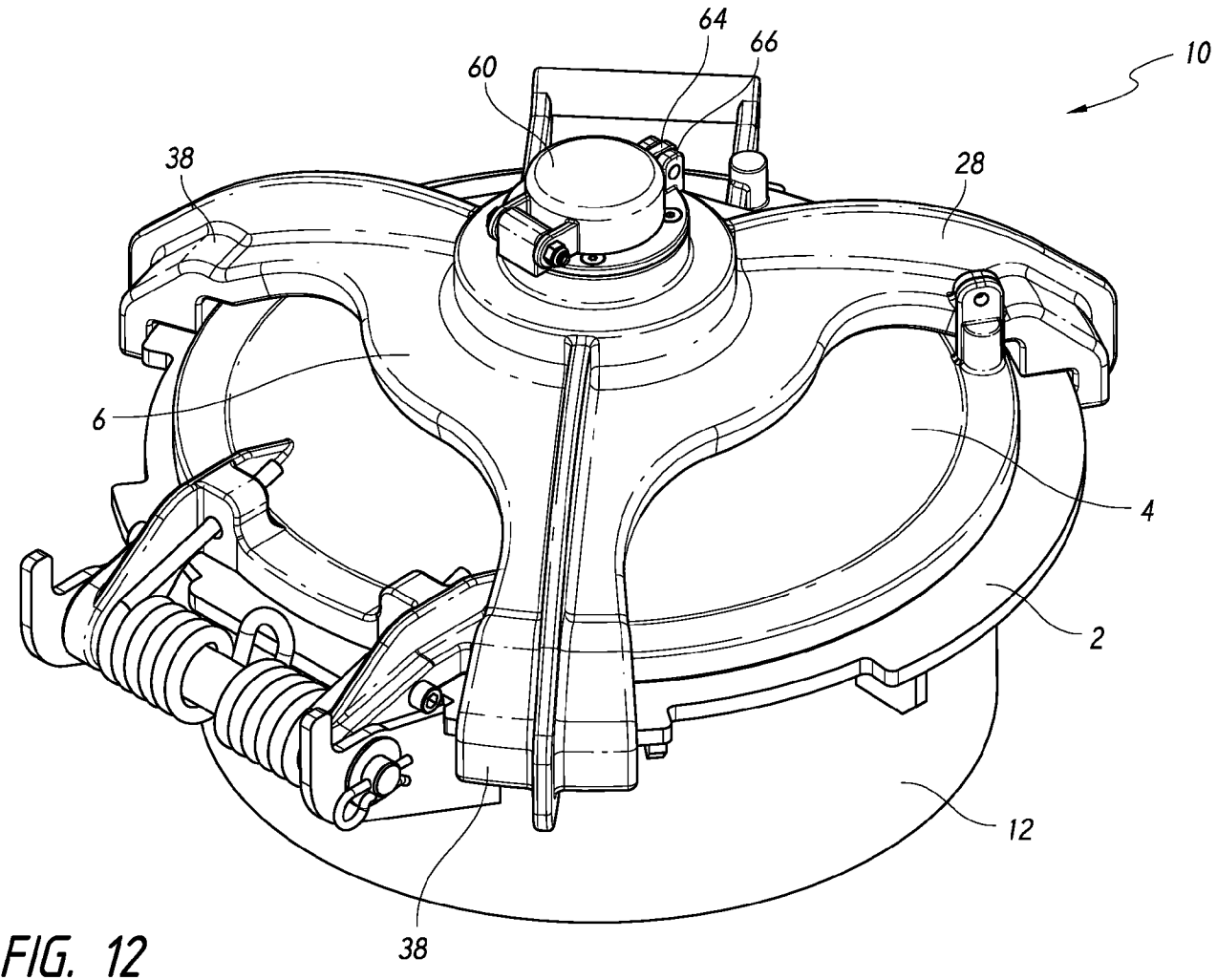

The flange 2 can also have one or more slots 32 that can facilitate attachment of the arms 38 of the strongback 6 to the flange. The arms 38 with corresponding slots 40 can be positioned at the slots when the cover 4 is "open," i.e. the cover is on the flange but not locked (FIG. 10). The arms can then be rotated so that the slots 40 of the arms engage the flange 2 (FIGS. 11-12).

Returning to FIG. 5, it can be seen that the slots 40 have top, bottom 46 and side surfaces. The width of the slot 40 is defined by the distance between the top and bottom surfaces. In some embodiments the slot does not have a clearly defined top and/or side surface. For example, the top and/or side surface(s) can be angled and may more clearly be part of the arm itself. The bottom surface 46 can be configured to engage a bottom 48 of the flange 2 and may be a ridge or ledge 46 extending from the arm. In addition, it is not required that the flange, slot, or ledge be flat, parallel, or horizontal surfaces—other shapes, angles, and configurations can be used.

As shown, the arms 38 can also include one or more support ribs 42. In addition, the cover 4 and strongback 6 can be cast or fabricated components.

The strongback 6 can also include an opening, such as a threaded opening 44 to engage the ram 8. The opening 44 can be centered on the strongback as shown, but can also be located elsewhere. The strongback 6 can connect to the cover 4 through the ram 8. The opening 44 can be a centering and positioning feature for the strongback 6. This configuration can also provide some shielding from outside dirt and debris. In addition, the slightly convex shape of the various components, including the cover and strongback can further allow debris (dirt, snow, ice) to fall off.

The ram 8 can be cast, forged or fabricated. As shown, the ram 8 has a threaded portion 50 and a flanged spherical end 24 that matches the contour of the center boss 22 on the cover 4. The spherical contact between the ram 8 and cover 4 can allow for increased contact surface, centering the clamping force and can allow for variations in the angle of contact. The body 50 of the ram can be threaded to match the thread in the strongback opening 44. This can allow for application of a clamping force as the distance between the strongback and the cover is increased.

Figure 6:
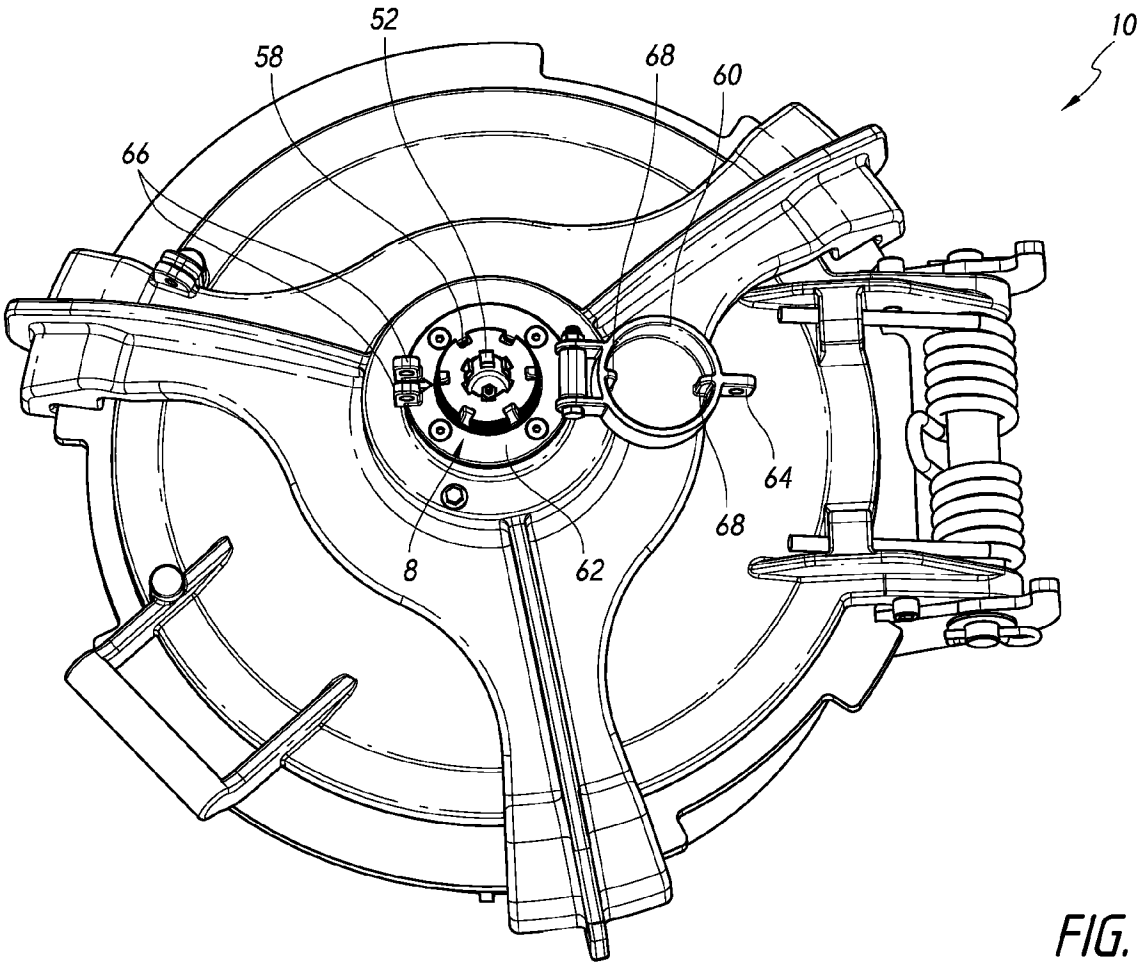
FIG. 6 is a view of top of the manway cover assembly.

A drive end of the ram 8 has a bearing surface 52 as shown in FIG. 6. The bearing surface 52 can be a socket 52 (shown), outer flats, or other surface to be engaged by a tool for rotating or otherwise moving the ram. The socket 52 can be a recessed spline 52, a square drive, a slot, hex, Allen, Philips, etc. In some embodiments, the bearing surface 52 is configured for applying rotational force to the ram during operation of the manway cover assembly 10. In some embodiments the bearing surface 52 can be a non-standard surface to limit operation to only certain tools. For example, a recessed drive socket 52 can restrict rotation of the ram 8 such that only tools designed for the application can open and close the manway cover assembly 10.

Figure 7:
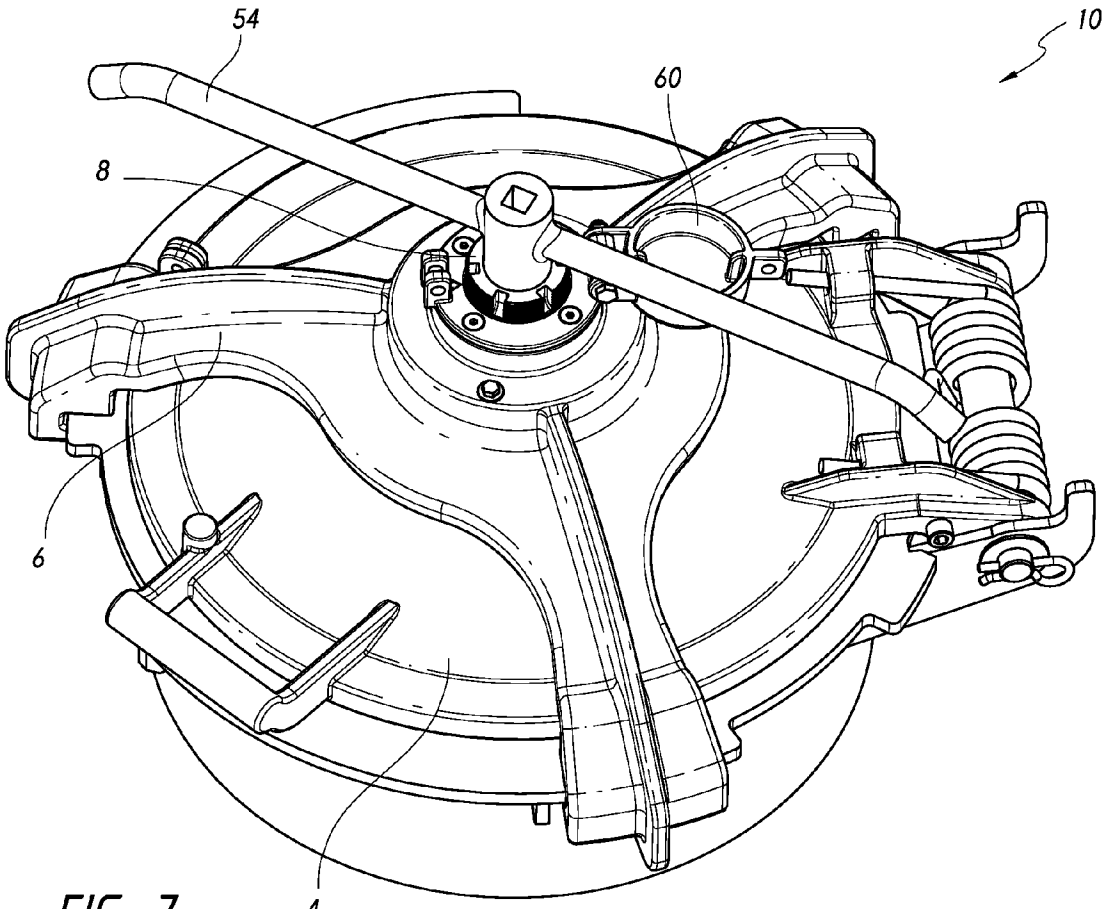
FIG. 7 shows a tool engaged with a ram on the manway cover assembly.
Figure 8:
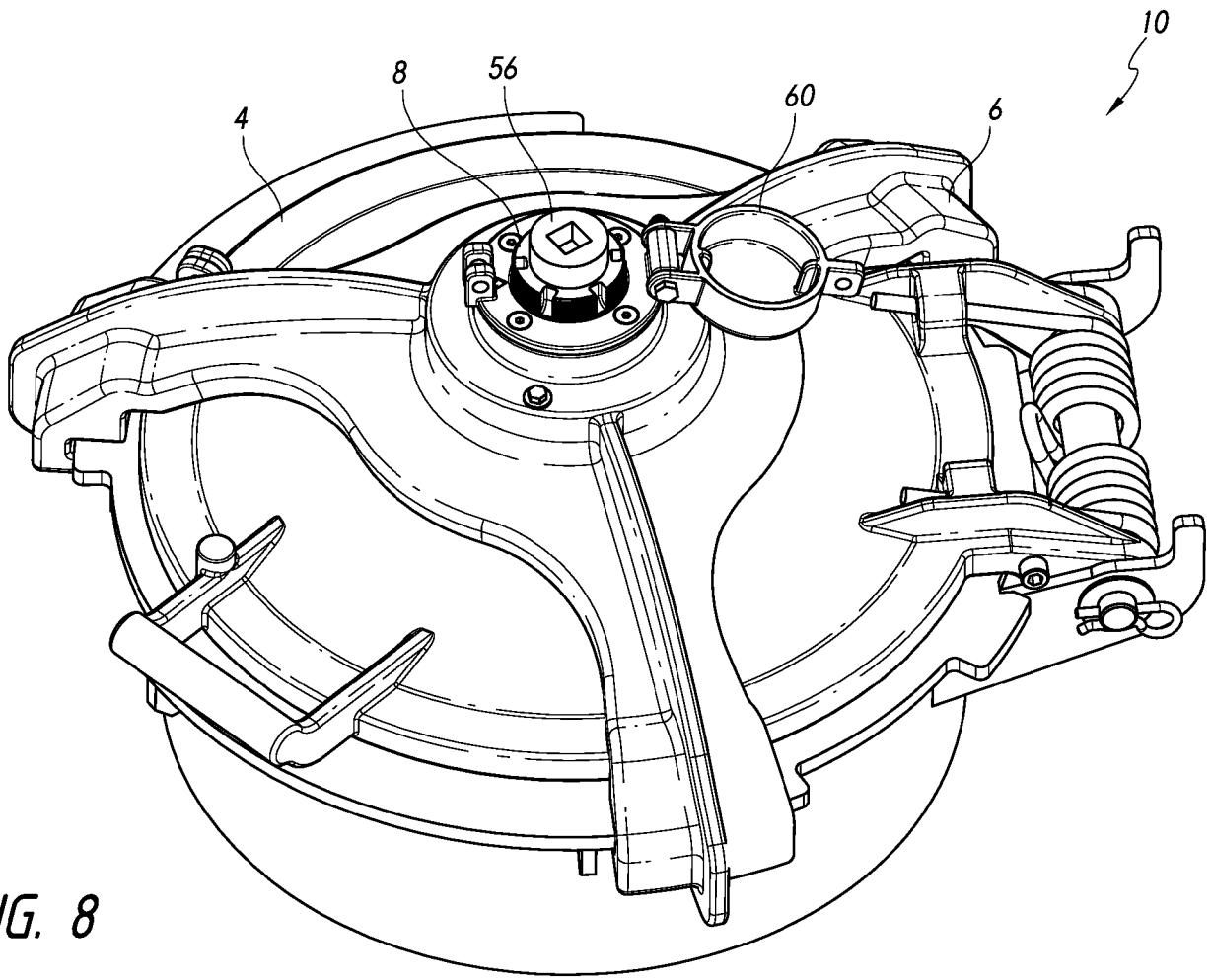
FIG. 8 shows an adaptor for a tool, the adaptor engaged with a ram on the manway cover assembly.
Figure 9:
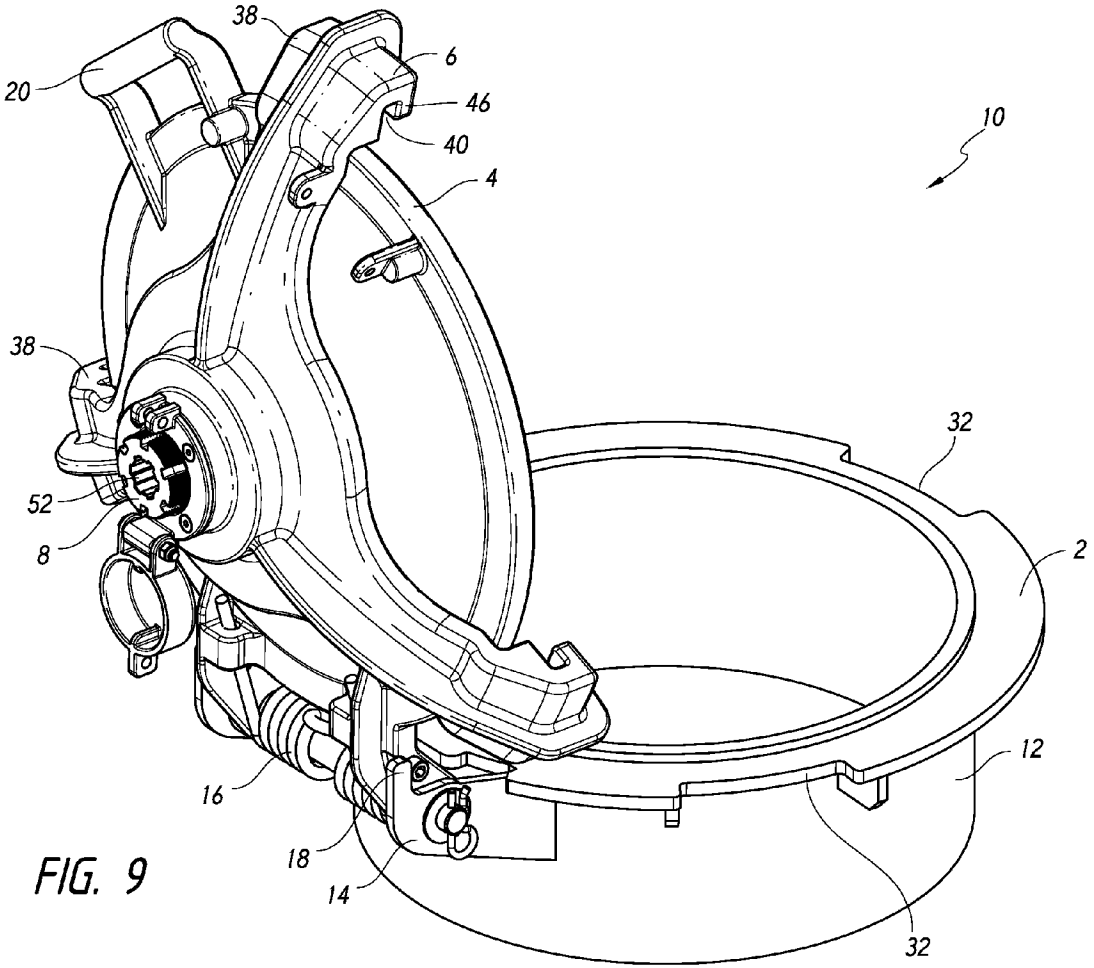
FIGS. 9-12 illustrate a method of closing the manway cover assembly.

FIG. 7 shows a tool 54 engaged with the socket for rotating the ram. The tool 54 can have a shape corresponding with that of the socket and one or more arms to facilitate movement of the ram. In addition, the tool can be a specially designed wrench for properly torqueing the ram. FIG. 8 shows an adapter 56 that can be engaged by another tool. The adapter 56 is shown with a square socket drive, but may include any of a number of different bearing surfaces.

The ram 8 can be relatively large in size. For example, the ram can have a diameter of 2 to 3 inches. This large size can also allow for a large socket 52. This large size of the ram and/or the socket can provide certain advantages. For example, it can make the system more robust and can also make it less likely to be tampered with because of size tool needed to rotate the ram. The large size can also help facilitate centering of the strongback. In some embodiments, the diameter of the ram is between 10% and 20% of the diameter of the cover. In some embodiments, the diameter of the ram is between 10% and 15% or between 15% and 20% of the diameter of the cover. In some embodiments, the cover can be between about 10 inches and 40 inches in diameter, or between 15 and 25 inches. In some embodiments the cover is 22.5 inches in diameter and is designed for use on a 20 inch diameter opening.

Returning to FIG. 6, it can also be seen that a cap 60 can be used to cover the bearing surface 52 of the ram 8. The cap is preferably attached to another component of the manway cover assembly 10. As shown, the cap 60 is hingedly attached to the strongback 6 through a cap base 62. In other embodiments, the cap can be connected to the strongback 6 with a chain, rope, cord, clip, etc. The cap 60 can protect the ram from debris, as well as limiting access to the bearing surface 52.

The illustrated cap 60 is hinged to a cap base 62 providing a single swinging open and closing action. The cap base 62 can be secured to the strongback using screws or other means to bond the two. In the closed position, the cap can be locked or secured in place. For example, the end of the cap opposite the hinge can have a tab with hole 64 that can be positioned adjacent one or more tabs with a hole 66 on the base plate or strongback. The holes can provide for locking the cap in place with a pin and/or security tag.

The cap 60 can also be used to limit rotation of the ram 8. The ram and cap can have corresponding engagement surfaces 58, 68 such that when the cap is secured in place on the ram the ram cannot fully rotate. For example, as shown, the top end of the ram 8 has one or more key slots 58 cut on the outside surface. The key slots can be used with a cap locking device 68 to secure the ram 8 from rotating inside of the strongback 6. This can be particularly useful to deal with vibration during transport of a railcar. This locking feature can be the hinged cap used here or a simple lock nut cap. In addition, the cap 60 may not completely enclose the end of the ram 8.

The cap locking device 68 can be a tab formed on the inside of the cap 60. The locking cap can provide anti-vibration rotation between the ram and strongback during transport of the railway tank car. The cap tab 68 also provides additional resistance to rotation between the cap and its base plate. The cap tab 68 can be one or more ribs designed to engage the slots 58 in the ram providing the anti-rotation feature.

Returning now to FIGS. 4 and 5, assembly of components of the illustrated manway cover assembly 10 will be discussed. The cover 4 is set on the nozzle 12 and flange weldment 2. The hinge can then be connected at the bracket 14. The ram 8 can then be positioned in the cover center boss 22 mating the spherical surfaces 24. The ram 8 can be retained with a flange or snap ring 26. This can keep the ram 8 positioned in the cover 4 so that any lifting of the ram 8 will also lift the cover 4. The strongback 6 can be aligned on the ram. Rotating the ram 8 clockwise engages the mating threads and the strongback 6 is drawn toward the cover 4. One of the strongback arms 38 with the slot 40 and/or ledge 46 is positioned between the open and closed stops 28, 30 on the cover 4. The cap 60 and base 62 can then be installed.

Operation of the Manway Cover Assembly

With reference to FIGS. 9-12, the operation of certain embodiments of manway cover assembly 10 will now be described. Looking to FIG. 9, the manway cover assembly 10 is shown in a fully open position allowing for access into the nozzle 12. If necessary, the strongback 6 can be rotated on the cover 4 counter clockwise (CCW) until one of the arms 38 contacts the open stop 28 on the cover. This will help ensure that the arms are in the proper location for attaching to the flange 2.

The cover 4 and strongback can be pivoted downward to contact the nozzle as shown in FIG. 10. The cover 4 and strongback 6 are guided by the hinge as they are lowered onto the nozzle 12 and flange 2. It can be seen that the strongback arms 38 are aligned with and positioned within the slots 32 on the flange 2. The strongback weight is supported by the ram 8 which is in contact through the spherical mating surface 24 with the cover 4.

The strongback can then be rotated clockwise (CW) to engage the flange 2. The CW motion can be made until the arm 38 contacts the close stop 30 on the cover. This rotation engages the slots 40 of the strongback arms 38 to the flange 2. The cover 4 cannot be opened when in this position, as the ledge 46 of the strongback arms 38 are under the flange 2.

Once in this position, the ram 8 can be fitted with a driving tool 54, 56 and rotated CW (FIGS. 7-8). This action at the threaded engagement between the ram 8 and the strongback 6 can lift the strongback 6 away from the cover 4. Rotation can occur until a set torque is achieved or until the ledges 46 at the slots 40 firmly engage the flange 2 such that clearance between the flange and strongback arms is removed. Additional CW rotation of the ram 8 can force the cover to seal the interface with the nozzle. A gasket may further be included on the cover to help seal this interface. The force applied to the cover 4 can provide uniform pressure on the sealing and on the sealing gasket if used. Having the strongback 6 centered on the cover can facilitate even distribution of forces.

Once tighten as desired; the cap 60 can be flipped over or rotated to cover the ram 8 as shown in FIG. 12. When the cap includes a locking feature, the ram can be rotated such that one of the slots 58 is aligned with a tab 68 on the cap. The cap 60 can then be closed to position the tab 68 within the slot 58. In some embodiments, an arrow (FIG. 6) on the cap base 62 or strongback can indicate the ideal position of the slot 58 to facilitate engagement with the cap tab 68.

Locks and/or security tags can be connected to the manway cover assembly 10 once fully closed and locked, or at other times during the operation. A lock, pin, or security tag can be connected to the tab with hole 64 on the cap 60 and the corresponding tabs with a hole 66 on the base plate or strongback. Similarly, a lock, pin, or security tag can be connected to the tab with hole 34, 36 on the cover and strongback.

To open the manway cover assembly 10, a method opposite that just described can be employed. For example, any locks, pins or security tags can first be removed from the locking cap tabs 64, 66 and/or the strongback/cover mating tab stops 30, 36. The locking cap 60 can be swung to the full open position allowing access to the ram driving feature. Using a ram driving tool the ram is rotated CCW until the strongback is loosely floating. The strongback is still engaged with the nozzle flange even though the force pushing the cover and gasket into the nozzle is removed. Advantageously, if the tank had been under internal pressure, the cover is held from blowing off by the engaged strongback but allowed to vent with a broken seal. The strongback can then be rotated CCW until it engages the open stop on the cover and the cover is then free to be lifted.

It will be understood that at times, the manway cover assembly 10 can be used in a situation where the tank contents are sticky. In addition, the content may be held under low pressure, the tank may not be pressurized at all. Some of the sticky contents may get on the frame, as at the opening to the nozzle, or they may get on the cover, such as on a gasket or seal on the cover. In currently available designs, these types of situations may require the cover to be pried off in order to be opened. Beneficially, the manway cover assembly 10, according to some embodiments, can loosen the cover without or reducing the need for additional tools to pry it off. In the typical operation, after rotating the ram 8 CCW to loosen the strongback 6 and the clamping force, the strongback 6 can be rotated and the cover 4 opened. But, where the cover 4 is stuck to the frame, continued CCW rotation of the ram 8, before rotating the strongback 6, can force the cover open. This is because continued rotation of the ram, while the cover remains in contact with the frame, causes the strongback arms 38 to engage the top surface of the flange 2. Thus, for example, the top surface of the slot 40 can engage the top surface of the flange 2 and mechanically pull or lift the cover away from the nozzle. In other embodiments, a portion of the arms 38 can contact the top surface of the flange. In view of the above, it will be understood that to facilitate this feature, the strongback and cover can be sized and contoured such that when the arms and or slot contact the top of the flange 2, there is sufficient space between the strongback and the cover to allow the cover to move upwards closer to the strongback.

In some embodiments, a manway cover assembly 10 can have a tightening system that it is all on one side of a cover. The tightening system can be a screw tensioning system. The manway cover assembly 10 can further include an attachment system having a ledge 46 configured to engage a flange 2 that surrounds an opening, the manway cover assembly 10 configured to control access to the opening.

According to some embodiments, a manway cover assembly 10 can have a screw tensioning system, a frame and a cover. The screw tensioning system can have a tensioning arm with a slot that slides onto a frame when the cover is positioned at the frame. The screw tensioning system can include a ram that attaches to the cover with a rotatable joint. The ram can also be threadedly attached to the tensioning arm so that rotation of the ram changes the relationship between the cover and the tensioning arm to lock or unlock the manway cover assembly 10. For example, when locking the manway cover assembly 10, turning the ram can force the cover into contact with the frame while advancing the tensioning arm away from the cover, the tensioning arm being fixed in place with relation to the frame because of the slot that engages the frame.

FIGS. 13-22 illustrate another embodiment of manway cover assembly 10'. Numerical reference to components is the same as previously described, except that a prime symbol (') has been added to the reference. Where such references occur, it is to be understood that the components are the same or substantially similar to previously-described components. It should be understood that the illustrated manway cover assembly 10' includes each of the features designated by the numbers used herein. However, as emphasized repeatedly herein, these features need not be present in all embodiments.

Comparing FIGS. 13-22 with FIGS. 1-12 certain similarities between the manway cover assemblies will be readily apparent. For example, it will be understood that the flange 2', cover 4', strongback 6', ram 8', and a nozzle 12' can all function in substantially the same way as previously described. Engagement between the cover 4' and either the flange 2' or the nozzle can control access to the tank or other structure through the manway cover assembly 10'. Rotation of the ram 8' can result in the strongback 6' moving either towards or away from the cover 4'. This can create the necessary forces to secure the manway cover assembly 10' in the locked position, while also facilitating opening of the manway cover assembly 10'.

There are also a number of differences between the manway cover assemblies of FIGS. 13-22 and FIGS. 1-12. Certain of these differences are highlighted below. For example, it can be seen that the arms 38' include two support ribs 42'. The rotation limiting stops 28', 30' have also been changed. The rotation limiting stops can control the open and closed positions of the strongback during operation of the manway cover assembly 10'. The closed stop 30' is illustrated as a flange, or tab, with a hole 34' that can align with a hole 36' on the support rib 42', rather than on a separate tab on the strongback 6'. When the strongback 6 is in the closed position, the holes 34', 36' can accept a security sealing tag or other security or locking device to prevent the manway cover assembly 10' from being opened.

The open stop 28' has also been modified. In addition to serving as an open stop, it can also provide a pressure release safety feature. The pressure release safety feature 28' can allow the cover 4' to open a small amount, while preventing it from becoming completely open without actuation by a user. This can help to allow a controlled pressure release from inside the hatch. This can also prevent a pressure release from potentially hurting someone or damaging the hatch. As can be seen, the pressure release safety feature can be a latch 28' such as a gravity fed hook that is biased towards a locked position. If moved upwards, the hook 28' can engage the flange 2' to prevent the cover from fully opening. This can for example, prevent the cover from popping open when there is large pressure different between the contents inside the tank and the atmosphere. It will be understood that any number of different mechanisms can be used as the pressure release safety feature.

Figure 13:
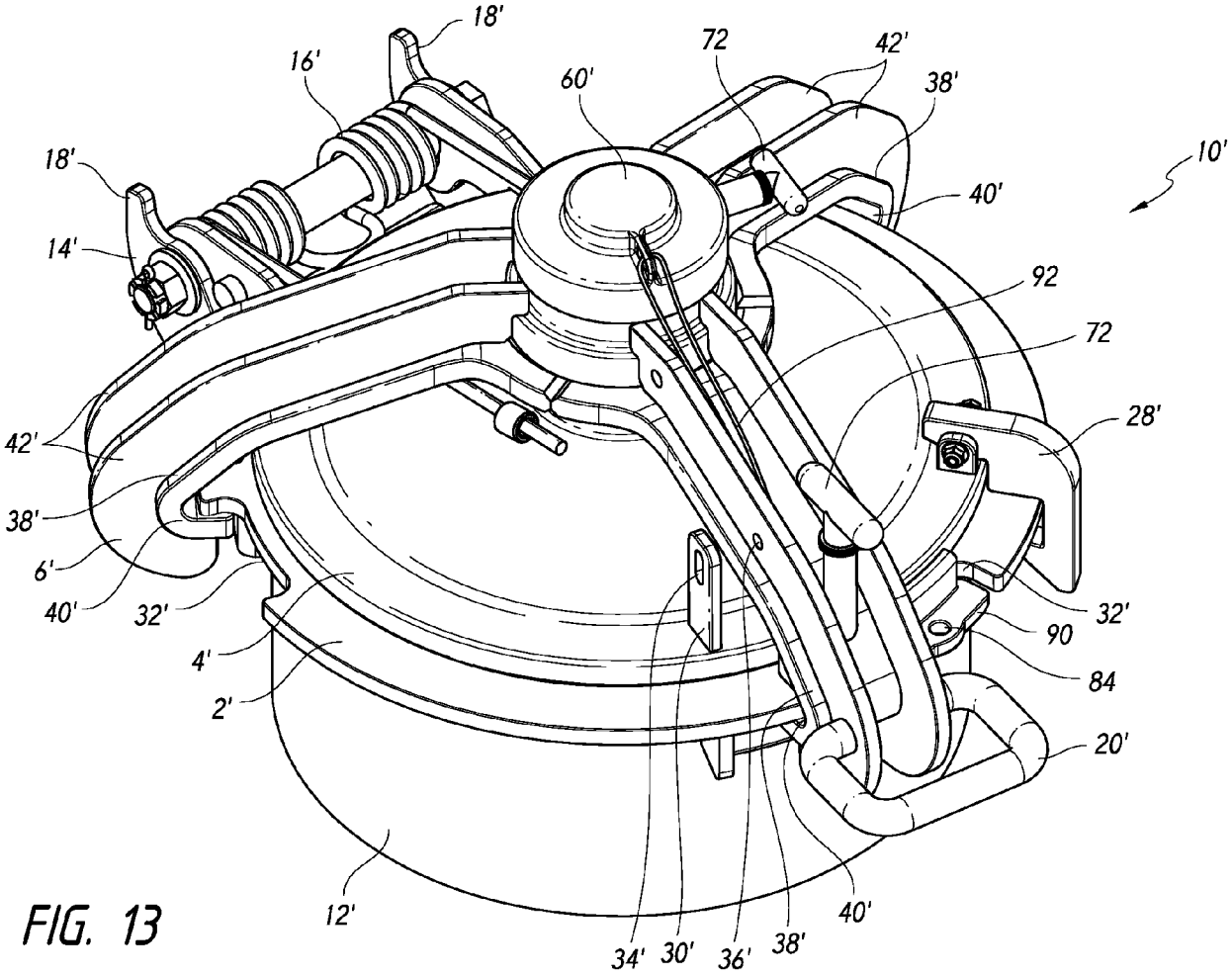
FIG. 13 is a perspective view of another manway cover assembly for a railroad car with the cover in a closed position.
Figure 14:
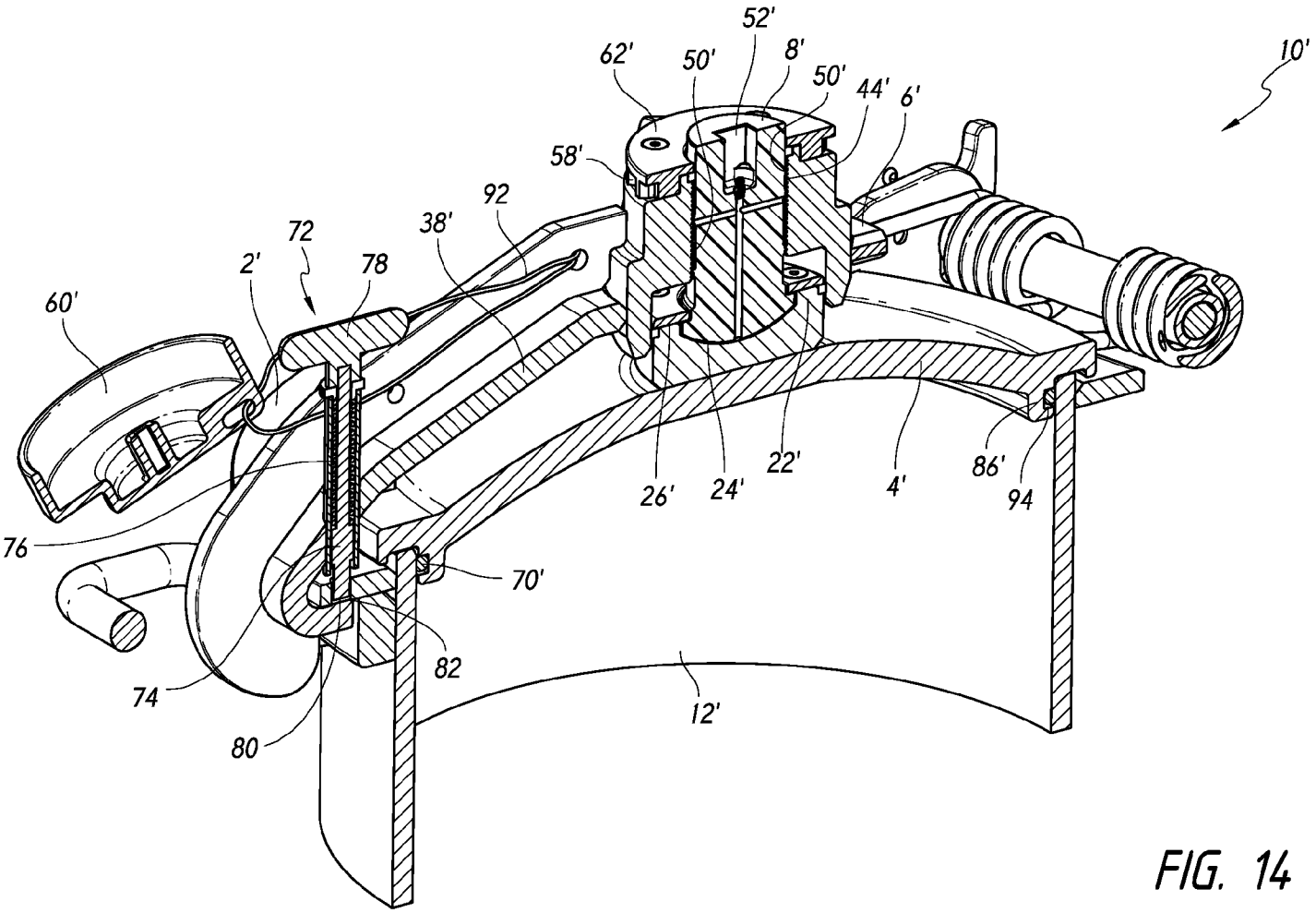
FIG. 14 illustrates a cross-section of the manway cover assembly.

Referring to FIG. 13, it can also be seen, that the manway cover assembly 10' can include one or more locks 72. A cross-section of a lock 72 can be seen in FIG. 14. A lock 72 can include a pin 74 and a spring 76 to bias the pin 74 to a locked position. A handle 78 can be located on one end of the pin to disengage the opposite end 80 from a hole 82, 84, 88, groove, slot 58', etc. The lock 14 in FIG. 14 is shown on an arm 38 of the strongback 6, but it will be understood that the lock can be located in any number of different places.

As will be understood, a lock 72 on the strongback 6' can be used to lock the strongback in position with respect to the cover 4' and/or flange 2'/nozzle 12'. The lock 72 can be used to prevent the strongback 6' from rotating, in particular while opening or closing the cover 4'.

Figure 15:
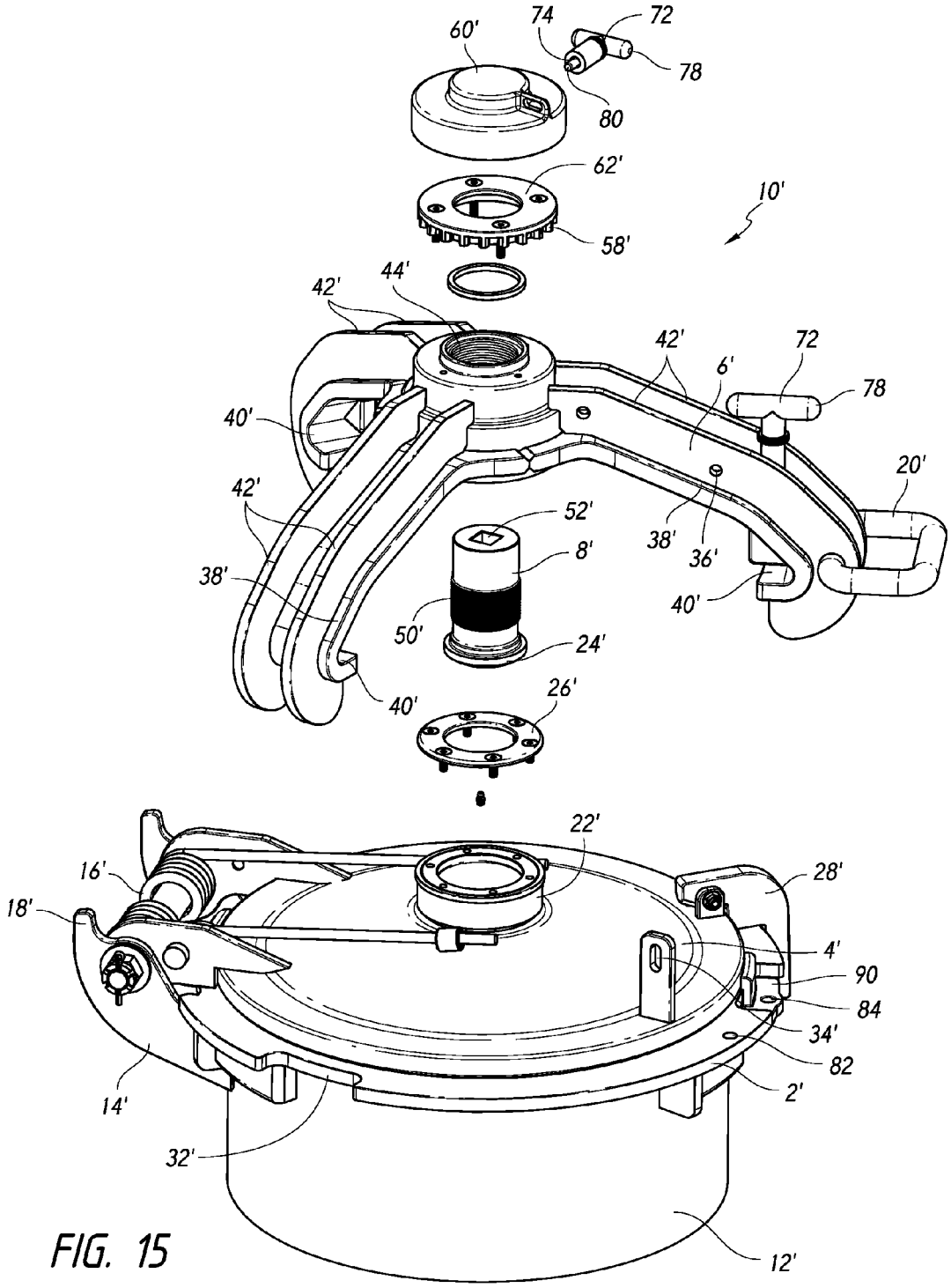
FIG. 15 is a partially exploded view of the manway cover assembly.
Figure 16:
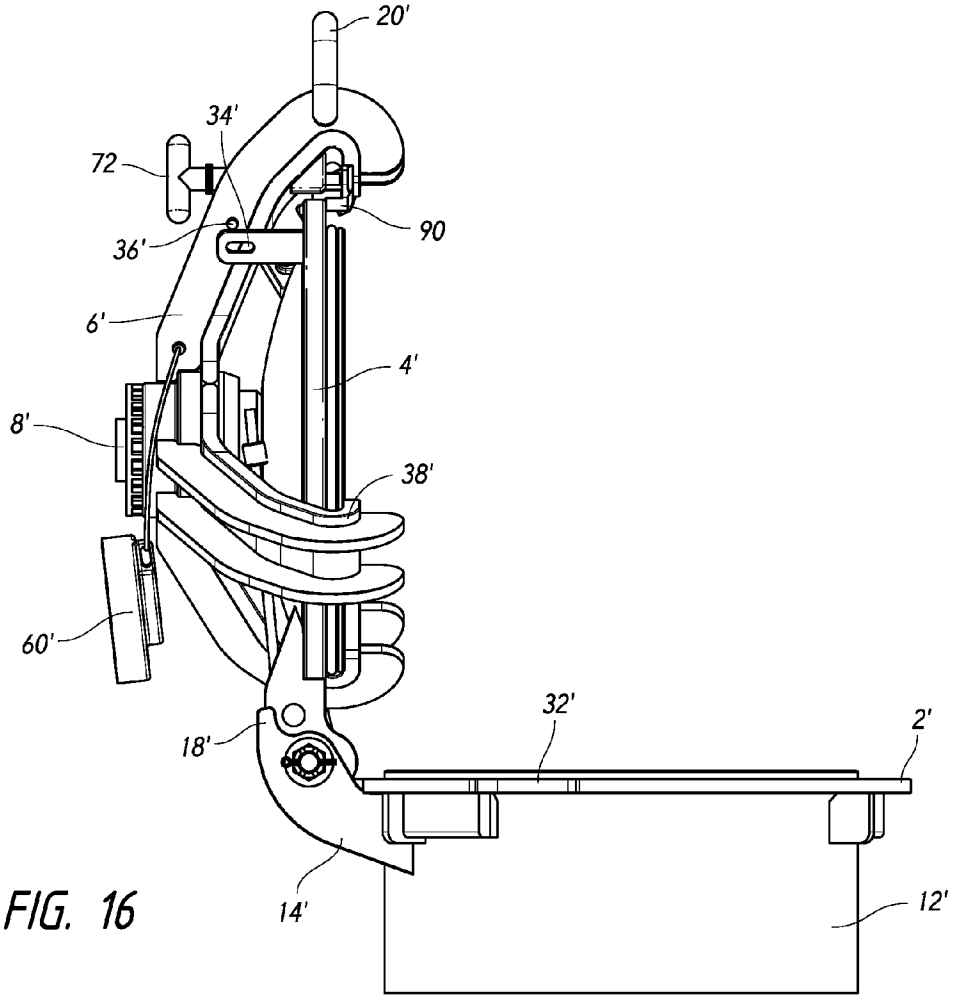
FIG. 16 is a side view of the manway cover assembly of FIG. 13 in an open position.
Figure 17:
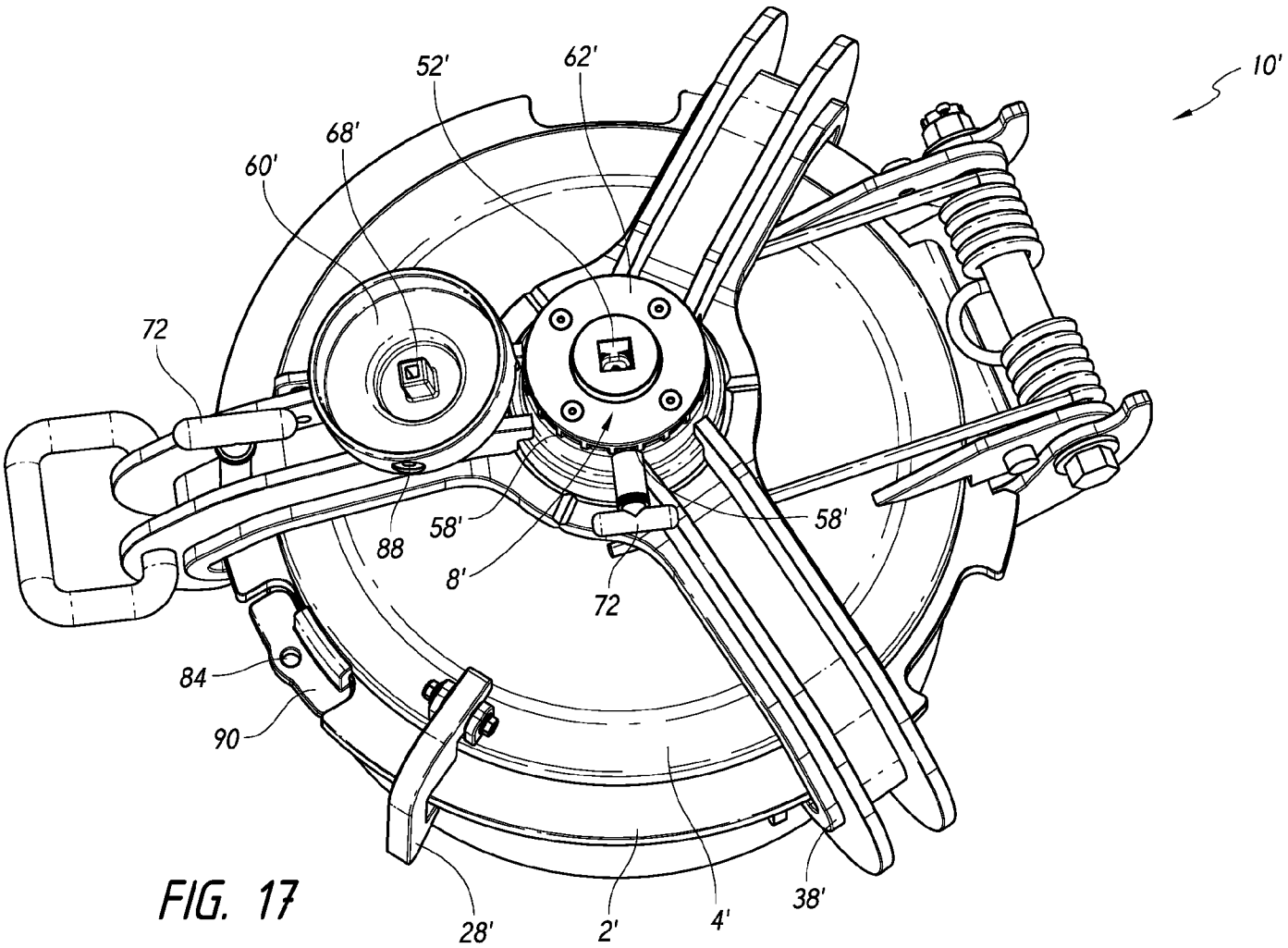
FIG. 17 is a view of top of the manway cover assembly in a closed position as in FIG. 14.

Looking now to FIG. 15, holes 82, 84 can be seen respectively on the flange 2' and the cover 4'. The end 80 (FIG. 14) of the lock 72 can engage with the hole 82 on the flange 2' in one position and with a hole 84 on the cover 4' in another position. In still another position, the end 80 of the lock 72 can be unengaged with any holes to allow for movement of the strongback 6' with respect to the cover 4' and/or flange 2'/nozzle 12'. For example, when the manway cover assembly 10' is in an unlocked position, (FIG. 16) the spring-loaded pin lock 72 can engage the hole 84 on the cover. When the manway cover assembly 10' has been moved down to cover the nozzle opening and then rotated, the spring-loaded pin lock 72 can engage the hole 82 on the flange (FIG. 17). It will be understood that the spring-loaded pin lock 72 can engage other parts of the manway cover assembly 10'. For example, in some embodiments the lock 72 can engage with different portions of the cover in either position.

In some embodiments, the cover 4' can include a protrusion 90 (FIGS. 15 & 17). The protrusion 90 can include the hole 84. The protrusion 90 can be sized to fit within one of the slots 32' on the flange 2'. A portion of the protrusion 90 with the hole 84 can be flush with, or slightly above or below the flange 2' when the cover 4' is in the closed position. In this way actuation of the handle 78 to unlock the lock can be similar in the various positions. As shown, the protrusion 90 is an "L" shaped protrusion that extends downwards and then outwards, but it will be understood that the protrusion can have any number of different shapes and configurations.

A number of different locks 72 can be included on a manway cover assembly. A second lock 72 is shown configured to lock the cap 60' in place. Continuing to refer to FIGS. 15 & 17, a lock 72 is shown configured to secure the cap 60' to the cap base 62'. The cap base 62' can be fixed in position to the arms 38'. The cap 60' and lock 72' can be adjusted based on the position of the ram 8' and the bearing surface 52' of the ram 8'. The cap 60 can protect the ram from debris, as well as limiting access to the bearing surface 52'.

As has been discussed previously, a drive end of the ram 8' has a bearing surface 52'. The bearing surface 52' can be a socket 52' (shown), outer flats, or other surface to be engaged by a tool for rotating or otherwise moving the ram. The socket 52' can be a recessed spline 52, a square drive 52', a slot, hex, Allen, Philips, etc. The bearing surface 52' is used to apply rotational force to the ram during operation of the manway cover assembly 10'. In some embodiments the bearing surface 52' can be a non-standard surface to limit operation to only certain tools. For example, a recessed drive socket 52' can restrict rotation of the ram 8' such that only tools designed for the application can open and close the manway cover assembly 10'.

A cap 60' can be used to cover the bearing surface 52' of the ram 8'. The cap is preferably attached to another component of the manway cover assembly 10'. As shown in FIGS. 13 and 14, a cord 92 attaches the cap 60' to the strongback 6'. In other embodiments, the cap can be connected to the strongback 6' with a chain, rope, clip, etc. or can the hingedly or otherwise attached. The cord 92 can be secured to any number of different features on the strongback 6', such as a hole in the arm 38' and/or support rib 42' (FIG. 14). The lock 72 can further secure the cap in place over the ram 8'.

The illustrated cap 60' is secured over the ram with the lock 72 engaging the cap base 62'. The cap base 62' can be secured to the strongback using screws or other means to bond the two. The cap base 62' can include a number of slots 58' (FIG. 15). The end 80 of the pin 74 of the lock 72 can engage with a slot 58' to lock the cap 60' in place.

As has been mentioned, the cap 60' can also be used to limit rotation of the ram 8'. The ram and cap can have corresponding engagement surfaces, such that when the cap is secured in place on the ram the ram cannot fully rotate. For example, as shown in FIG. 17, a cap locking device 68' can be sized to fit within the bearing surface 52' of the ram 8'. As shown, the cap locking device 68' can be a protrusion having a profile that matches the profile of the hole defined by the bearing surface 52', here both being square. Further, the lock 72 can lock the cap 60' to the cap base 62. The cap base has a plurality of slots 58' so that the lock can be engaged essentially independently of the position of the ram 8'. The lock 72 itself can rotate about the cap base 62' or be permanently secured to the cap 60'. For example, the lock 72 can be secured to the cap 60' at the hole 88. If the lock rotates about the cap base, it can be rotated to align with the hole 88 when the cap is on the ram.

Figure 18:
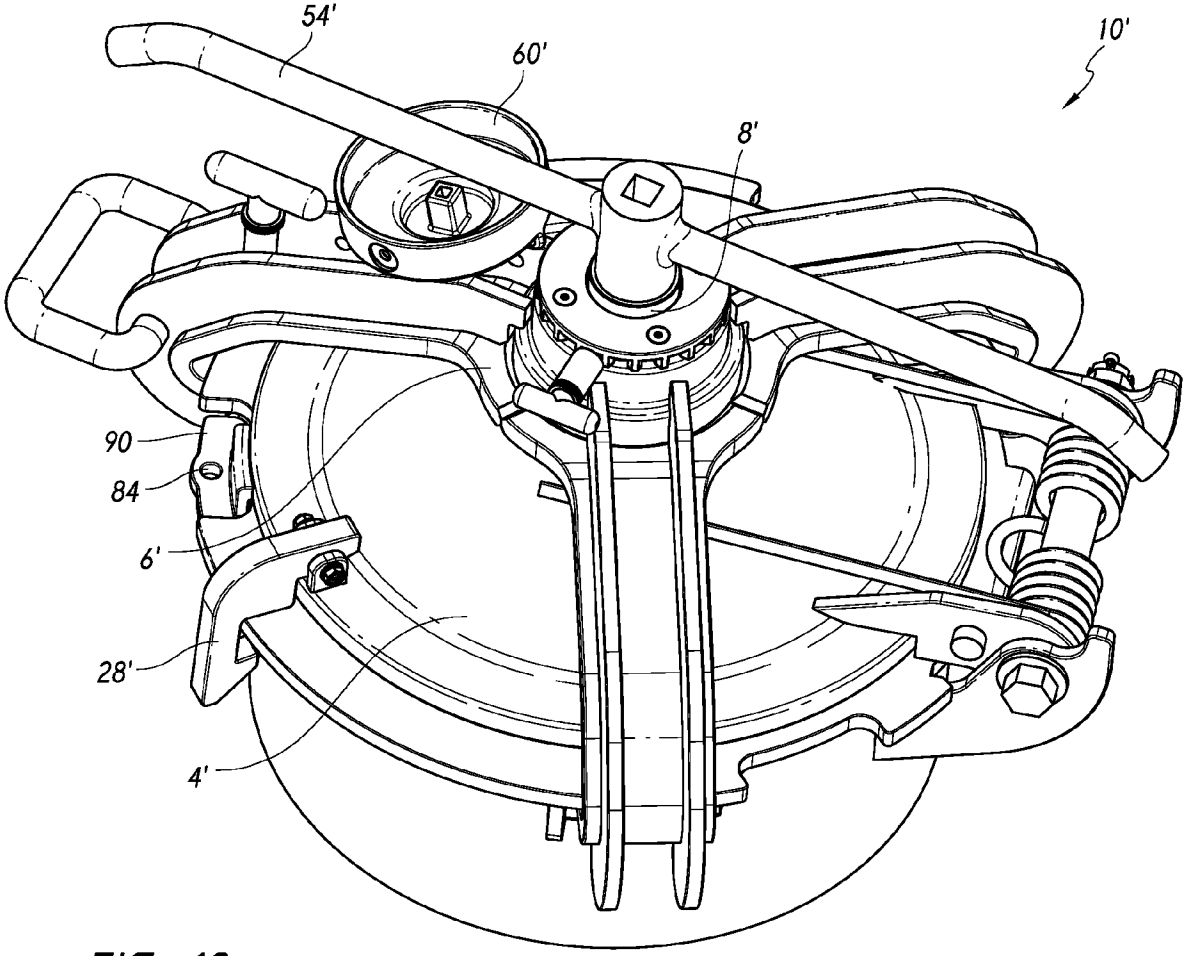
FIG. 18 shows a tool engaged with a ram on the manway cover assembly.
Figure 19:
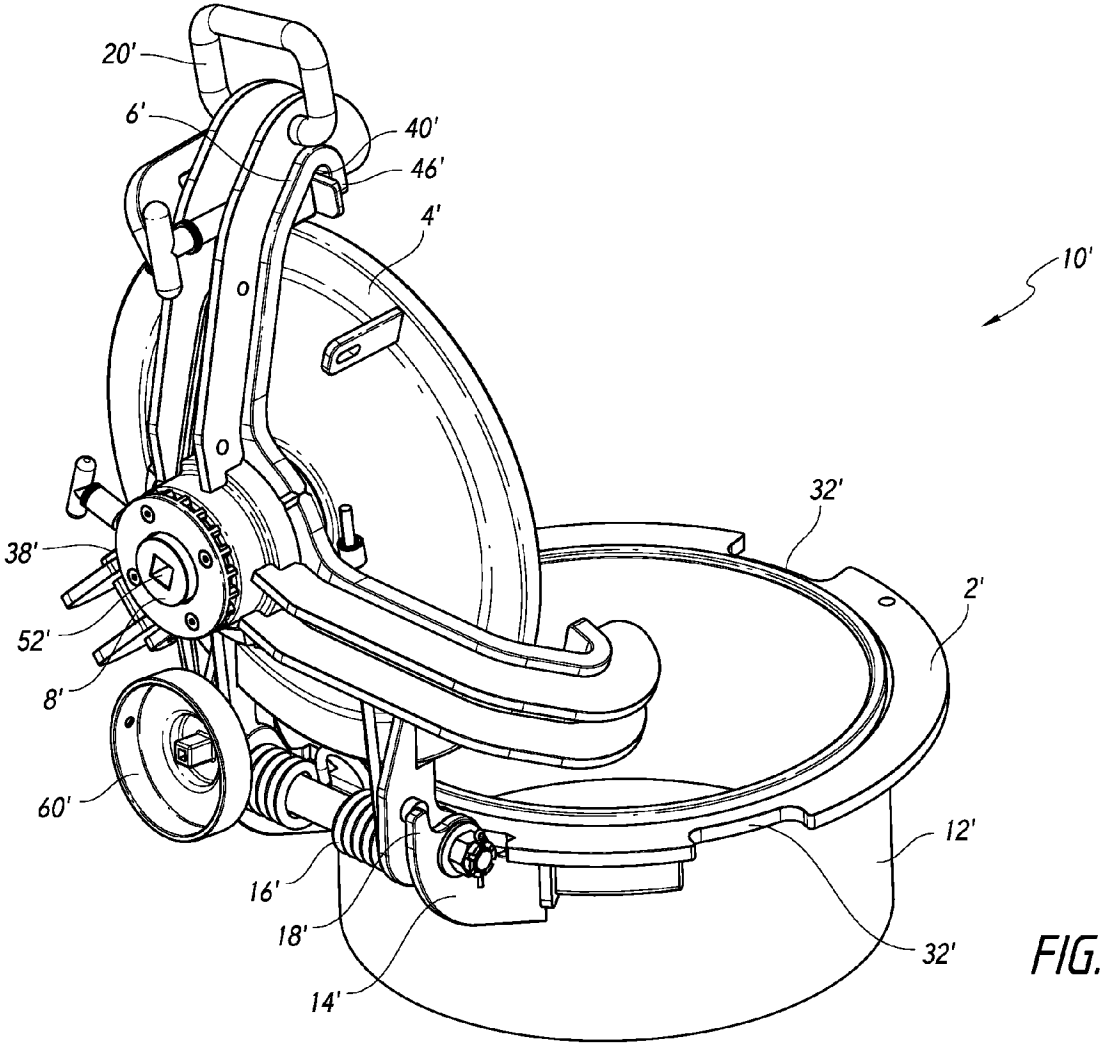
FIGS. 19-22 illustrate a method of closing the manway cover assembly.
Figure 20:
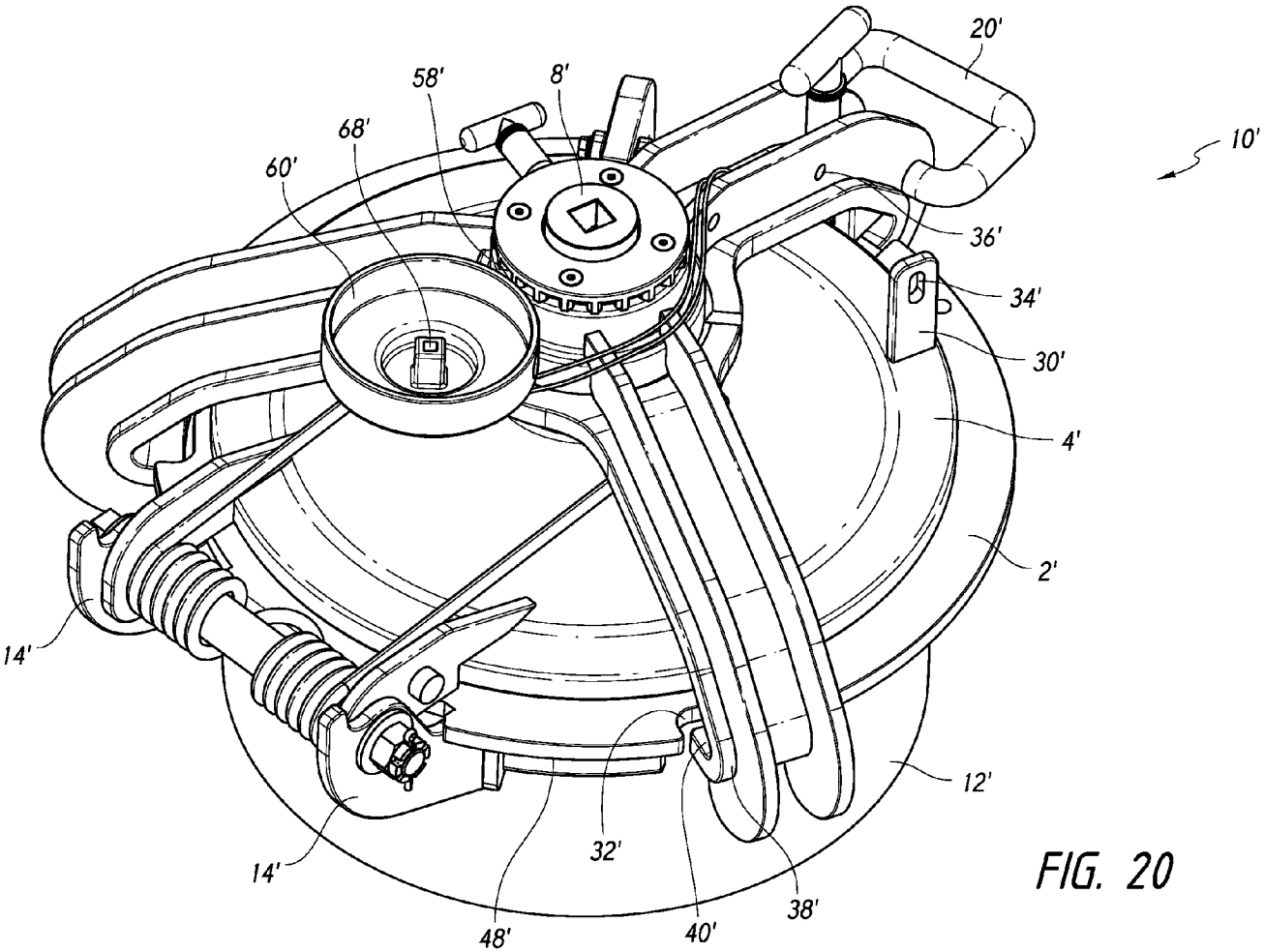
Figure 21:
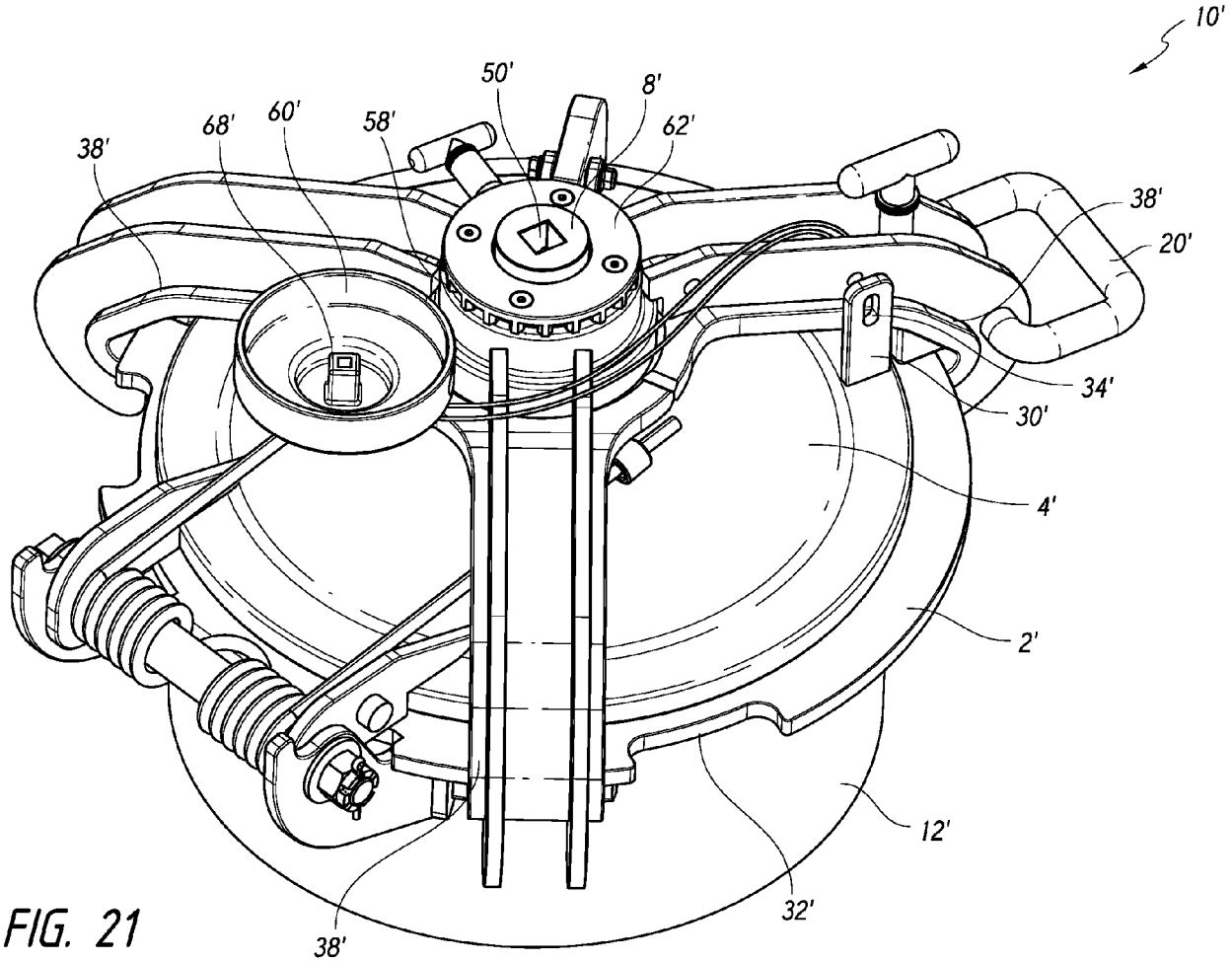
Figure 22:
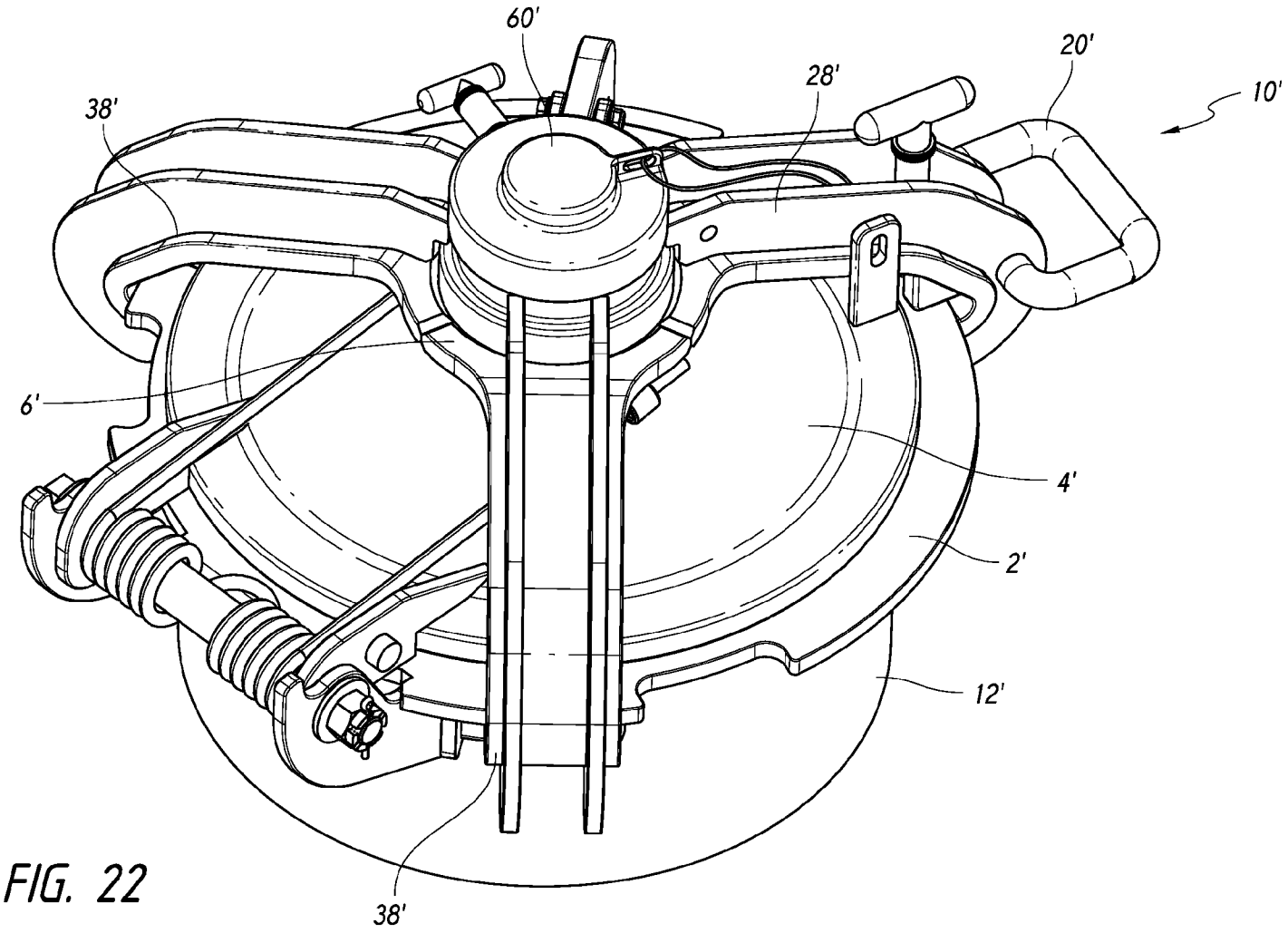

As will be understood, pulling on the handle 78 can release the lock from the slot 58'. The cap can then be removed from covering the ram. With the cap removed a tool 54' can engage the socket on the ram as shown in FIG. 18.

Looking to FIGS. 19-22, the manway cover assembly 10' can be opened and closed substantially as described with the manway cover assembly 10 of the prior embodiments with the addition of the actuation of the locks 72 and other differences some of which have been described above.

With the manway cover assembly 10' in the closed position, the cover 4' can be sealed to the nozzle 12' in an airtight manner, this best seen in the cross-section of FIG. 14. A gasket 70' on the cover 4' can engage with the wall of the nozzle 12' to form a seal. The gasket 70' can be a sealing ring such as an O-ring as shown, but can also have other shapes and configurations. In some embodiments the gasket can be made of an elastomer such as TEFLON.

The cover 4' can have a flange or ring 86 that extends downward from the bottom of the cover. The ring 86 can include a radially-outwardly opening groove or side channel 94 in which the O-ring 70' can sit. In some embodiments, the inner end of the nozzle can be machined to ensure a good seal with the O-ring.

The gasket 70' can provide a lateral seal with the nozzle 12'. This lateral seal can beneficially deal with increases in pressure within the tank car. For example, the high pressures in some tank cars can result in the cover rising by upwards of ⅛ of an inch. This can be counteracted with high torque on the ram or bolt, but even then, there may be some rising of the cover. If the cover is not properly secured, the seal can break, causing leakage. A seal on the top of the nozzle may be broken if the cover rises up. The lateral seal shown in FIG. 14 can maintain sealing engagement, even in some situations where the cover is not properly secured. A high pressure within the tank car can result in the cover rising with no effective change in the seal between the cover and the nozzle.

It will be understood that any of the individual features described with respect to FIGS. 13-22 can be used with the manway cover assembly 10 of FIGS. 1-12. For example, the pressure release safety feature 28' can be used instead of or in addition to the open stop 28. As another example, one or more spring-loaded pin lock 72 could also be used on the manway cover assembly 10 of FIGS. 1-12.

Turning now to FIGS. 23-25A another embodiment of manway cover assembly 10" is shown. Numerical reference to components is the same as previously described, except that a double prime symbol (") has been added to the reference. Where such references occur, it is to be understood that the components are the same or substantially similar to previously-described components. It should be understood that the illustrated manway cover assembly 10" includes each of the features designated by the numbers used herein. However, as emphasized repeatedly herein, these features need not be present in all embodiments.

Figure 23:
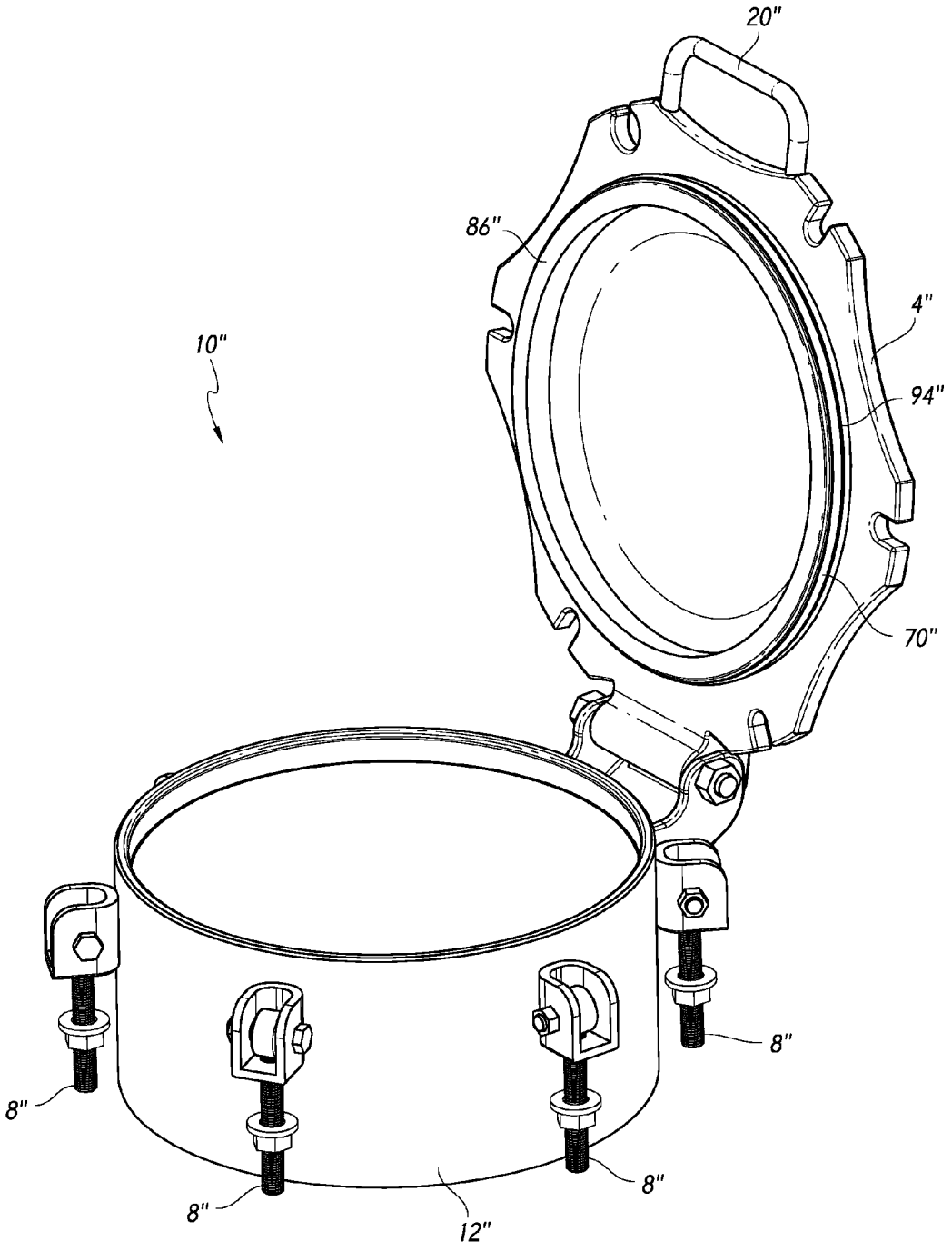
FIG. 23 is a perspective view of another manway cover assembly for a railroad car with the cover in an open position.
Figure 24:
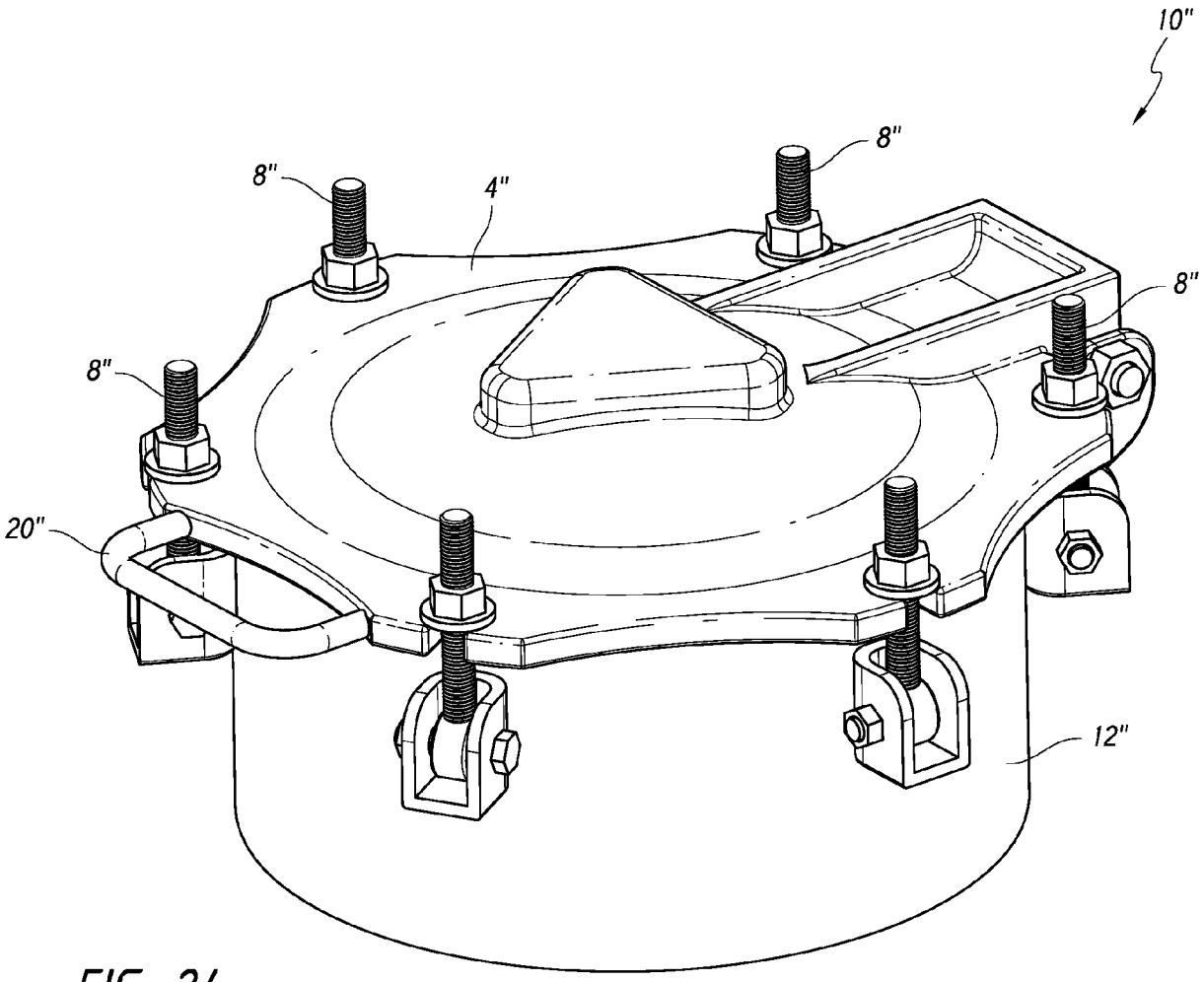
FIG. 24 shows a perspective view of the manway cover assembly with the cover in a closed position.
Figure 25:
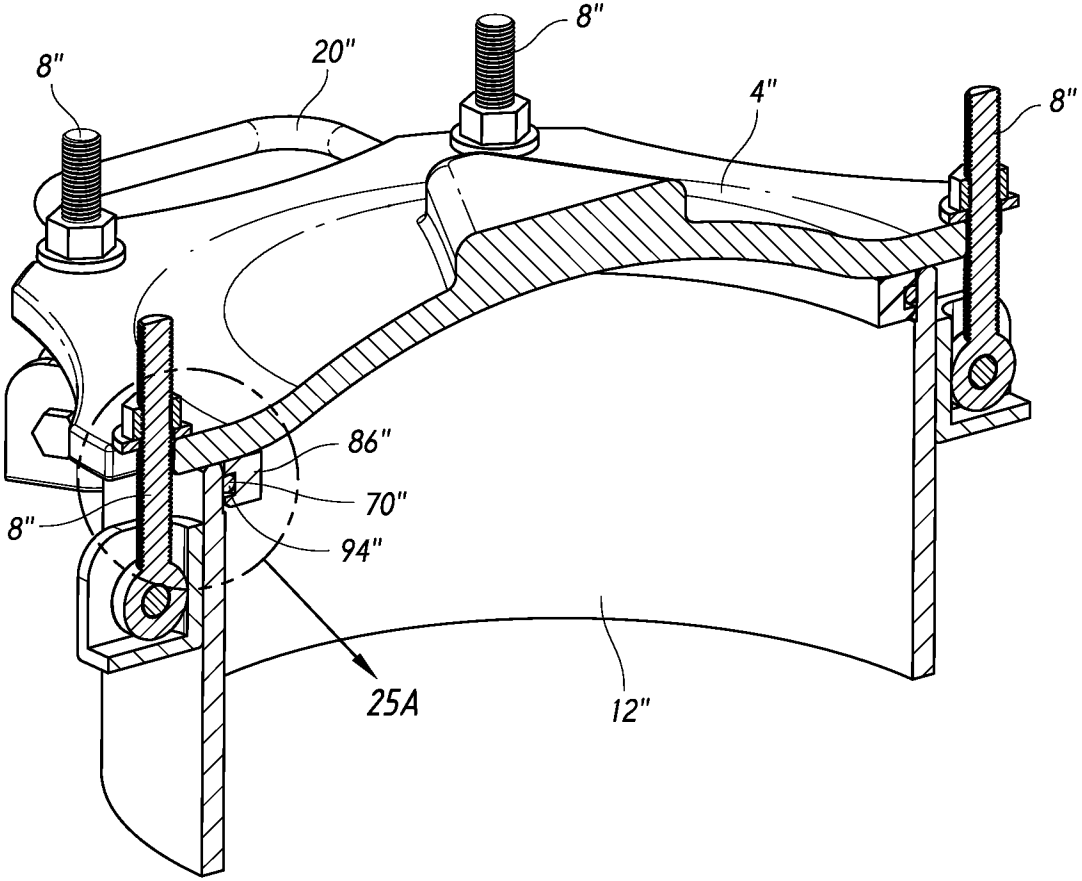
FIG. 25 is a cross-section of the manway cover assembly.
Figure 25A:
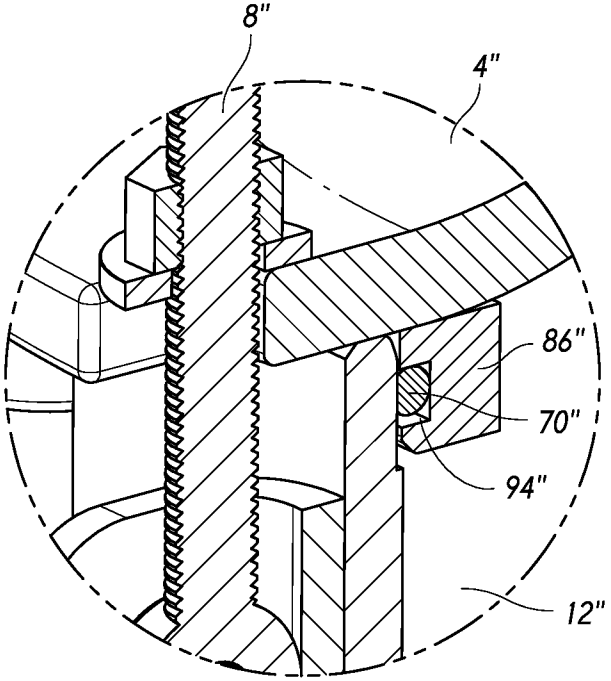
FIG. 25A is a detail of the cross-section taken along line 25A of FIG. 25.

The manway cover assembly 10" is a multi-bolt system. In the illustrated embodiment, instead of a single bolt or ram 8, there are six eye bolts 8". It will be understood that the multi-bolt system can have any number of bolts such as 6, 8, 10, and 12. FIGS. 23 and 24 show the manway cover assembly 10" in open and closed positions. In the cross-section of FIGS. 25 and 25A a sealing arrangement similar to that of FIG. 14 is shown.

With the manway cover assembly 10" in the closed position, the cover 4" can be sealed to the nozzle in an airtight manner. A gasket 70" on the cover 4" can engage with the wall of the nozzle 12' to form a seal. The gasket 70" can be a sealing ring such as an O-ring as shown, but can also have other shapes and configurations.

The cover 4" can have a flange or ring 86" that extends downward from the bottom of the cover. The ring can be a separate piece secured to the cover, but can be also be cast or molded as the same piece. The ring 86" can include a radially-outwardly opening groove or side channel 94" in which the O-ring 70" can sit. It can also be seen that the inner end of the nozzle has been machined to ensure a good seal with the O-ring along various heights of the seal. The machined surface can have a surface finish with a roughness average (Ra) of less than or equal to about 250 microinches (6.35 micrometers). In some embodiments, it can be less than or equal to about 500 microinches, 400 microinches, 300 microinches, 200 microinches or 100 microinches. For example, an inch or two of the end of the nozzle can be machined to ensure a proper seal with an O-ring ⅛, ¼, ½, ¾ or 1 inch tall (i.e. diameter of the profile). The nozzle can be cast and an end mill can be used to finish the end of the nozzle to provide a smooth surface for engagement with the gasket 70". In some embodiments, the nozzle 12" can also include a chamfered or rounded end. This can help ensure that the ring 86" can fit within the nozzle 12". For example a radially outer beveled corner can be configured to aid in receiving the ring in the opening as the cover is moved from the open position to the closed position.

The gasket 70" can also extend outward from the ring 86". This can allow for pressure inside the tank to act on the gasket as well as the cover. This force acting on the gasket can encourage the gasket to flatten out, thus increasing the lateral forces on the side of the nozzle and helping to ensure a strong seal is maintained. Preferably, the gasket is compressed only by the groove and the side wall of the nozzle.

As has been explained, the gasket 70" can provide a lateral seal with the nozzle 12". This lateral seal can beneficially deal with increases in pressure within the tank car. For example, the high pressures in some tank cars can result in the cover rising up by upwards of ⅛ inch (3 mm). This can be counteracted with high torque on the ram or bolt, but even then, there may be some rising of the cover. If the cover is not properly secured, the seal can break, causing leakage. Even if the bolts 8" are initially properly secured, they may come lose over time. A seal on the top of the nozzle may be broken if the cover rises up. The lateral seal shown can maintain sealing engagement, even in some situations where the cover is not properly secured. A high pressure within the tank car can result in the cover rising with no change in the seal between the cover and the nozzle.

In some embodiments, a manway cover assembly can be used for selectively sealing an access passageway of a tank. The manway cover assembly can comprise a frame, a lid unit and a securing mechanism to secure the lid unit with the frame when the lid unit is in a closed position. The frame can comprise a radially inner surface, a radially outer surface, and an axial axis. A first end portion of the frame can be adapted to be joined with the tank. A second end portion is axially opposite the first end portion. The second end portion can have a radially inner edge and define an opening. The lid unit can be rotatably connected with the frame and moveable between an open position and a closed position. The lid unit can cover the opening of the second end portion of the frame in the closed position.

The lid unit can comprise a cover with a flange having a radially-outwardly opening groove and a sealing ring in the radially-outwardly opening groove. The flange can be received in the opening of the frame when the lid unit is in the closed position. The lid unit can be configured such that, when the lid unit is in the closed position, the sealing ring is radially compressed between a back surface of the groove and the radially inner edge of the second end portion of the frame, thereby providing a sealing connection between the lid unit and the frame.

In some embodiments, when the lid unit is in the closed position, the cover is configured to move axially away from the frame up to about 3 mm in response to pressure in the tank; and the sealing ring is configured to move axially with the cover, and to slide axially along and relative to the radially inner edge of the second end portion of the frame, thereby maintaining the sealing connection between the lid unit and the frame. In some embodiments, an endmost portion of the second end portion of the frame abuts with the cover without a resilient seal intervening axially therebetween. In some embodiments, the frame further comprises an intermediate portion between the first end portion and the second end portion, the intermediate portion having a radially inner surface with a first diameter; the flange of the cover of the lid unit further comprises a radially outer surface with a second diameter; the radially inner edge of the second end portion of the frame has a third diameter; and the first diameter is less than the second diameter, and the second diameter is less than the third diameter.

According to some embodiments, a manway cover assembly can comprise a conduit comprising a radially inner wall, an opening, and a radially outer wall with a plurality of connection points; a cover configured to couple with the conduit, the cover movable between open and closed positions; and a securing mechanism. The cover can comprise a plurality of recesses corresponding to the plurality of connection points; a flange configured to be received in the opening of the conduit when the cover is in the closed position, the flange comprising a groove with a back surface, the groove opening in a radially-outward direction; and a seal in the groove, the seal being radially compressed between the radially inner wall of the conduit and the back surface of the groove when the cover is in the closed position. The securing mechanism can include a plurality of eye bolts corresponding to the plurality of connection points, one of each of the eye-bolts connected with the conduit via one of the connection points, the eye-bolts configured to engage with the recesses in the cover and to secure the cover relative to the conduit.

A method of manufacturing a manway cover assembly can include one or more of the following steps. Obtaining a frame comprising a radially inner wall and a passageway. Obtaining a lid unit comprising a cover and a flange, the flange comprising a radially outwardly opening groove. Installing a sealing ring in the radially outwardly opening groove. Connecting the lid unit with the frame. Rotating the lid unit relative to the frame such that the lid unit covers the passageway in the frame. Radially compressing the sealing ring between the radially inner wall of the frame and the groove. Securing the lid unit relative to the frame.

Some embodiments of the method may further include one or more of the following steps. Receiving the flange in the passageway of the frame. Installing a sealing ring in the radially outwardly opening groove by passing the sealing ring over a bevel on a radially outer corner of the flange. Machining the inner wall of the frame. Machining the inner wall of the frame can comprise machining the inner wall to have a surface finish with a roughness average (Ra) of less than or equal to about 250 microinches (6.35 micrometers). Rotating a ram to change a relationship between a strongback and the cover.

A method of using a manway cover assembly can inhibit leakage from a passageway of a tank. The manway cover assembly can comprise a lid unit and a frame, the lid unit comprising a cover and a flange, the flange comprising a radially outwardly opening groove, the frame comprising a radially inner wall and an opening. The method can comprise closing the manway cover assembly, wherein closing the manway assembly can comprise: moving the lid unit into engagement with the frame such that the flange is received inside the opening of the frame; covering the passageway of the tank with the lid unit; radially compressing the sealing ring between the radially inner wall of the frame and the radially outwardly opening groove; and forming an air-tight seal between the sealing ring and the frame. The method can further include securing the manway cover assembly, wherein securing the manway cover assembly can comprise: engaging a securing mechanism with at least one of the lid unit and the frame; and substantially immobilizing, with the securing mechanism, the lid unit relative to the frame when the tank is at about atmospheric pressure. Pressurizing the tank above atmospheric pressure can cause the lid unit away to move upward, away from the frame. This can cause sliding of the sealing ring along the inner wall of the frame. The method can further include maintaining the air-tight seal between the sealing ring and the frame.

According to some embodiments, securing the manway cover assembly can include tightening at least six eye-bolts. In some embodiments, the pressurizing the tank above atmospheric pressure comprises pressurizing the tank to at least about 100 psi. It will be understood that the pressure inside the tank can depend on a number of factors, including: the contents and the temperature. A railway tank car can have an operating pressure of 10-15 psi, but is often more commonly around 35 psi.

A railway tank car and therefore a manway cover assembly on a railway tank car can be rated to withstand a maximum pressure of 165 psi with a safety factor of 1.5 so that the tank car is tested to 206 psi. Though this is standard in some countries, it will be understood that the various embodiments of manway cover assembly discussed herein can be rated to withstand and/or can be tested to withstand 140, 150, 165, 175, 190, 200, 210, 220, 230, or 250 psi. The manway cover assemblies can also be used with a high pressure tank car with a pressure rating of about 500 psi, or between 400-600 psi.

The manway cover assemblies can be made of a number of materials, but are preferably made of metal. The parts can be steel castings and/or welded in some embodiment. Additional details on materials, testing and other features of manway cover assemblies can be found in the Association of American Railroads (AAR), Manual of Standards and Recommended Practices Section C-III, Specification for Tank Car, Specification M-1002 (2014), which is incorporated herein and made a part of this specification. The Specification M-1002 is incorporated in its entirety, including the Appendices, reference being made in particular to Appendix D and E on testing and design criteria.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A manwaycover assembly comprising:

a frame comprising a radially inner wall and an opening;

a lid unit rotatably coupled to the frame, the lid unit movable between an open position and a closed position, the lid unit configured to cover the opening in the closed position, the lid unit comprising:

a flange configured to be received in the opening of the frame when the lid unit is in the closed position, the flange comprising a groove with at least a top surface and a back surface, the groove comprising a radially outward opening; and a seal positioned within the groove, the seal configured to be radially compressed between at least the radially inner wall of the frame, the top surface, and the back surface of the groove when the lid unit is in the closed position; and a securing mechanism configured to secure the lid unit with the frame when the lid unit is in the closed position.

2. The manway cover assembly of claim 1, wherein the seal is movable within the groove.

3. The manway cover assembly of claim 1, wherein the securing mechanism comprises a plurality of bolts to secure the lid unit with the frame.

4. The manway cover assembly of claim 1, wherein the securing mechanism comprises a strongback and a ram.

5. The manway cover assembly of claim 1, wherein the securing mechanism comprises a single-bolt system to secure the lid unit with the frame.

6. The manway cover assembly of claim 1, wherein the seal is an o-ring.

7. The manway cover assembly of claim 1, wherein the flange further comprises a radially outer beveled corner configured to aid in receiving the flange in the opening as the lid unit is moved from the open position to the closed position.

8. The manway cover assembly of claim 1, wherein an endmost portion of the frame abuts with the lid unit without a resilient seal intervening therebetween.

9. The manway cover assembly of claim 1, wherein:

the flange further comprises a radially outer edge; and when the flange is received in the opening of the frame, the radially outer edge of the flange is spaced apart from the radially inner wall of the frame, thereby providing a path between the frame and the lid unit for pressure from a tank to be applied to the seal.

10. The manway cover assembly of claim 1, wherein the seal is compressed only between one or more surfaces of the groove and the radially inner wall of the frame.

11. The manway cover assembly of claim 1, wherein:

when the lid unit is in the closed position, the cover is configured to move axially away from the frame up to about 3 mm in response to pressure in the tank; and the sealing ring is configured to move axially with the cover, and to slide axially along and relative to the radially inner edge of the second end portion of the frame, thereby maintaining the sealing connection between the lid unit and the frame.

12. The manway cover assembly of claim 1, wherein the flange has a defined length that is configured to position the groove at a defined depth relative to an endmost portion of the frame when the lid unit is in the closed position, wherein the defined depth is configured to accommodate for axial movement of the lid unit relative to the frame.

13. A method of using a manway cover assembly to inhibit leakage from a passageway of a tank, the manway cover assembly comprising a lid unit and a frame, the lid unit comprising a cover and a flange, the flange comprising a groove with at least a top surface and a back surface, the groove comprising a radially outward opening and a seal positioned within the groove, the frame comprising a radially inner wall and an opening, the method comprising:

closing the manway cover assembly, wherein closing the manway assembly comprises:

moving the lid unit into engagement with the frame such that the flange is received inside the opening of the frame;

covering the passageway of the tank with the lid unit;

compressing the seal between at least the radially inner wall of the frame and the groove; and forming an air-tight seal between the seal and the frame;

securing the manway cover assembly, wherein securing the manway cover assembly comprises:

engaging a securing mechanism with at least one of the lid unit and the frame; and substantially immobilizing, with the securing mechanism, the lid unit relative to the frame when the tank is at about atmospheric pressure; and pressurizing the tank above atmospheric pressure, wherein the lid unit moves away from the frame due to the pressure in the tank, and the seal moves relative to the inner wall of the frame to maintain the air-tight seal between the seal and the frame.

14. The method of claim 13, wherein engaging the securing mechanism comprises tightening a plurality of bolts to substantially immobilize the lid unit relative to the frame.

15. The method of claim 13, wherein engaging the securing mechanism comprises manipulating a strongback and a ram to substantially immobilize the lid unit relative to the frame.

16. The method of claim 13, wherein engaging the securing mechanism comprises tightening a single-bolt securing system to substantially immobilize the lid unit relative to the frame.

17. The method of claim 13, wherein pressurizing the tank above atmospheric pressure comprises pressurizing the tank to at least about 100 psi.

* * * * *